US010150543B2

(12) United States Patent
Johnston et al.

(10) Patent No.: US 10,150,543 B2
(45) Date of Patent: Dec. 11, 2018

(54) METHOD FOR RIGGING AND CONTROLLING A WING SAIL

(71) Applicants: Gregory Owen Johnston, Bicton (AU); Patrick Johnston, South Headland (AU)

(72) Inventors: Gregory Owen Johnston, Bicton (AU); Patrick Johnston, South Headland (AU)

( * ) Notice: Subject to any disclaimer, the term of this patent is extended or adjusted under 35 U.S.C. 154(b) by 3 days.

(21) Appl. No.: 15/025,954

(22) PCT Filed: Oct. 1, 2014

(86) PCT No.: PCT/AU2014/050264
§ 371 (c)(1),
(2) Date: Mar. 30, 2016

(87) PCT Pub. No.: WO2015/048854
PCT Pub. Date: Apr. 9, 2015

(65) Prior Publication Data

US 2016/0236762 A1 Aug. 18, 2016

(30) Foreign Application Priority Data

Oct. 1, 2013 (AU) ..... 2013903784

(51) Int. Cl.
*B63H 9/10* (2006.01)
*B63H 9/08* (2006.01)
(Continued)

(52) U.S. Cl.
CPC ..... *B63H 9/10* (2013.01); *B63B 15/0083* (2013.01); *B63H 9/0607* (2013.01);
(Continued)

(58) Field of Classification Search
CPC ..... B63H 9/10; B63H 9/0607; B63H 9/0642; B63H 9/08; B63B 15/0083
See application file for complete search history.

(56) References Cited

U.S. PATENT DOCUMENTS 4,064,821 A 12/1977 Roberts, Jr. et al.
4,757,779 A 7/1988 Graveline
(Continued)

FOREIGN PATENT DOCUMENTS

AU 5239986 7/1986
DE 4207539 A1 9/1993
GB 2405628 A 3/2005

OTHER PUBLICATIONS

International Search Report for PCT/AU2014/050264 dated Dec. 23, 2014.

(Continued)

*Primary Examiner* — Stephen P Avila
(74) *Attorney, Agent, or Firm* — Kim Winston LLP

(57) ABSTRACT

A rigging comprises a mast controllably about a longitudinal axis; a flexible sail comprising a starboard and port flexible sail portions; a plurality of elongated battens which extend a luff and a leach of sail portions; each batten is pivotally connected to a respective outermost part of the respective side of the mast. Rotation of the mast causes the battens connected to one of the sail portions to be compressed along their length and causes the battens connected of the other sail portions to be tensioned along their length so as to change the shape of an aerofoil formed by the sail.

30 Claims, 18 Drawing Sheets

(51) Int. Cl.
*B63B 15/00* (2006.01)
*B63H 9/06* (2006.01)

(52) U.S. Cl.
CPC ..... *B63H 9/0642* (2013.01); *B63H 9/08* (2013.01); *B63B 2015/005* (2013.01); *B63H 2009/065* (2013.01); *B63H 2009/082* (2013.01); *B63H 2009/084* (2013.01); *B63H 2009/088* (2013.01)

(56) References Cited

U.S. PATENT DOCUMENTS 4,766,831 A 8/1988 Johnston
5,799,601 A 9/1998 Peay

OTHER PUBLICATIONS

International Preliminary Report on Patentability for PCT/AU2014/050264 dated Dec. 10, 2015.
Written Opinion of the International Preliminary Examining Authority dated Aug. 17, 2015.

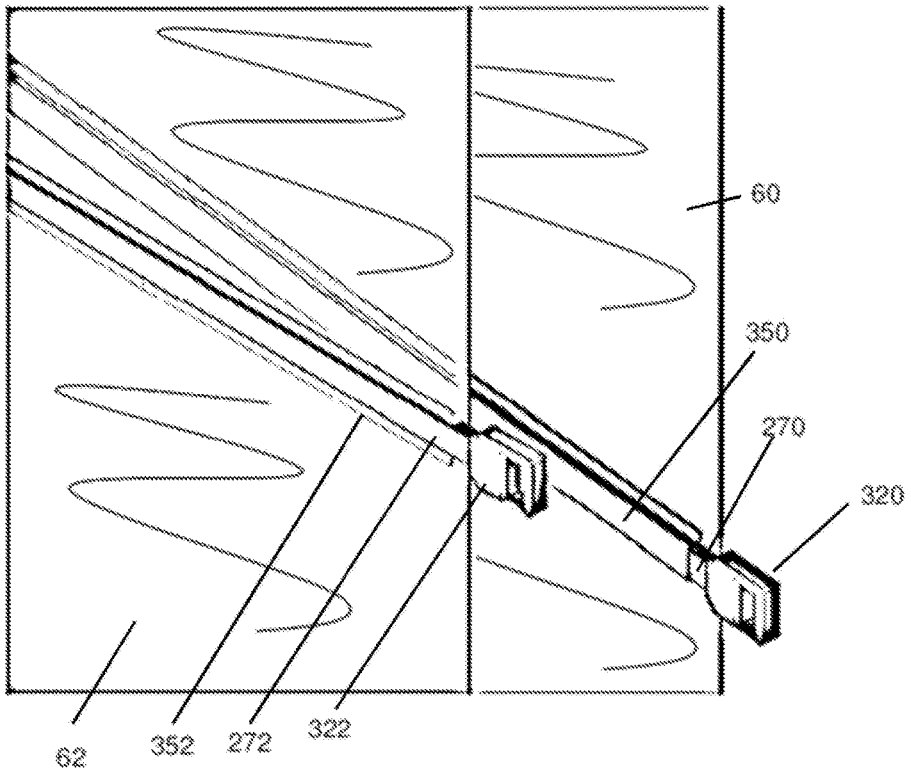
FIG. 19
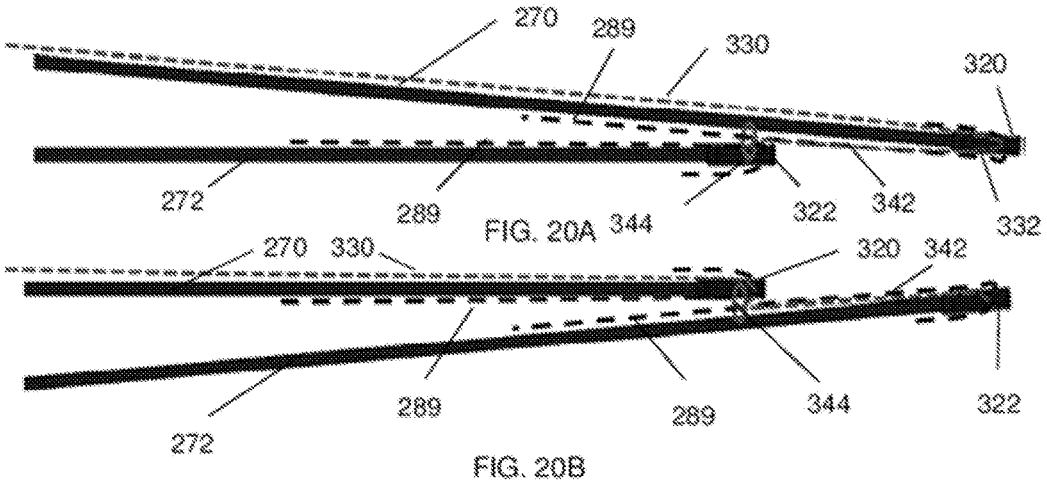
FIG. 20A
FIG. 20B

METHOD FOR RIGGING AND CONTROLLING A WING SAIL

CROSS-REFERENCE TO RELATED APPLICATIONS

This application is a national phase application under 35 U.S.C. § 371 of International Application No. PCT/AU2014/050264 filed Oct. 1, 2014, which claims priority to Australian Patent Application No. 2013903784 filed Oct. 1, 2013, the entire disclosures of which are hereby incorporated by reference in their entirety.

FIELD OF THE INVENTION

The present invention relates to a wing sail or wind propelled craft.

BACKGROUND

The apparatus of the present invention will hereinafter be described with particular reference to wind propelled craft being sailing vessels such as sailing dinghies, sailing catamarans, or sailing keel boats. However, it is understood that the apparatus is of general applicability.

In general sails used to propel craft are either relatively thin, compared to their length, or comprise combinations of thick symmetric aerofoils, such as in AC72 class catamarans seen in the 2013 America's Cup competition.

Sails or aerofoils create lift by the action of a differing air velocity from one side of the sail to the other. Stagnation of the air at the luff or mast on the windward side of the sail, along with the shape of the aerofoil section, creates an asymmetry in the air path from the windward to the leeward sides of the sail or aerofoil. Consequently, given that other aerodynamic conditions are satisfied regarding the joining of the flow streams downwind of the sail or aerofoil, this asymmetry creates increases the speed of the air on the leeward side relative to the windward side and hence an pressure difference between the leeward and windward sides. This pressure differential results in aerodynamic lift. It is this lifting force which then propels the vessel. At the same time, the sail or aerofoil also produces aerodynamic drag, which when sailing upwind, for example, can reduce the force which propels the vessel. Hence it is desirable for wind propelled vessels to be able to produce relatively high lift and relatively low drag, particularly for sailing with the wind forward of the beam of the vessel.

While the thick symmetrical wing sails used on AC72 catamarans and other high performance sailing craft can provide good lift and drag characteristics. These wings are typically made from two or more symmetrical wing sections configured relative to one another to provide camber. There is no ability to induce asymmetry into the individual wing sections. Thus, these wing sails have practical limitations. These wing sails are constructed to be light weight and rigid. They cannot be collapsed tor easy storage.

Further, they cannot be reefed or stowed when sailing if it is desirable to have less sail area. These wing sails are also generally quite fragile and can be easily damaged in the event of a capsize or collision.

While reefable and stowable "soft" wing sails exist, they are genrally quite complex and heavy.

A wing sail is described by Johnston, Patrick Murray (in patents AU1986052399 and U.S. Pat. No. 4,766,831, the contents of which are incorporated herein by reference). The wing sail comprises two substantially identical flexible sail portions each having a leach and a luff. Elongated battens are in contact with the flexible sail portions. A control rod has the battens and luffs of the sail portions rotatably attached so that the perpendicular distance between the sail portions varies wherein angular displacement of the control rod with respect to the boom causes the battens to be compressed along their length so as to bend one of the sail portions to increase the camber thereof and causes the battens of the other sail portions to be tensioned along their length so as to partly straighten the other sail portion which decrease the distance from each other at the luff, but increase the perpendicular distance between the sail portions away from the luff, resulting in asymmetry of the aerofoil. Notably the leaches of the sail portions are connected. Further the control rod is recessed in a concave shaped trailing edge of a mast. A leading edge of the mast is semi-elliptical and aerodynamic, so as to have a wing mast profile.

The present invention provides improvements over this prior wing sail.

SUMMARY OF THE INVENTION

According to an aspect of the present invention there is provided a rigging comprising:

- a mast having a starboard side and a port side, wherein the mast is controllably rotatable in either direction about a longitudinal axis;
- a flexible sail comprising a starboard flexible sail portion and a substantially identical port flexible sail portion, each flexible sail portion having a luff and a leach, wherein the luff of each sail portion is connected to a respective side of the mast;
- a plurality of elongated battens, each of which extends substantially between the luff and the leach of one of the respective sail portions, each of which is in contact with the respective flexible sail portion, and each of which is pivotally connected to a respective starboard or port side of the mast;
- wherein rotation of the mast causes the battens connected to one of the sail portions to be compressed along their length so as to bend one of the sail portions to increase the camber thereof and causes the battens connected of the other sail portions to be tensioned along their length so as to partly straighten the other sail portion which changes the shape of an aerofoil formed by the sail.

In an embodiment the mast comprises substantially flat portions at an angle to each other, each flat portion ending in a corner on one of the sides of the mast and at which the respective flexible sail portions are connected, wherein when the mast is rotated in one direction the surface of the flat portion on the side with the sail potion having the resulting increased camber and the surface of the that sail portion have an air flow there-over that is relatively flat or undergoes a relatively small change in direction.

In an embodiment the surface of the flat portion on the side with the sail potion having the resulting increased camber and the surface of the that sail portion have the air flow there-over that is most flat substantially before a maximum rotation of the mast in that direction.

In an embodiment the interface between the mast and the sail portion that is partly straightened has a rounded or non-sharp corner.

In an embodiment the mast to sail portion that is partly straightened interface comprises an acute angle, wherein the airflow past the interface reattaches to the sail portion relatively close to the mast.

In an embodiment the mast is profiled so that when the mast is rotated in one direction airflow passing from the mast to sail portion with the increased camber that remains relatively attached to the sail portion.

In an embodiment the mast is profiled so that when the mast is rotated in one direction airflow passing from the mast to sail portion that is partly straightened reattaches to the sail portion relatively close to the mast.

In an embodiment the attachment of the luff of at least one of the sail portions is such that there is no gap or only a small gap between the luff and the mast.

In an embodiment the small gap is such that it discourages airflow on the windward side through the gap.

In an embodiment the small gap is positioned where it is most likely for there to be an airflow separation bubble on the windward side.

In an embodiment the angle between the flat portions is between 60 and 100 degrees, preferably between 70 and 95 degrees and most preferable about 90 degrees.

In an embodiment there is a convex curved portion between the flat portions. In an embodiment the mast is symmetrical on its port and starboard sides.

In an embodiment the mast is rotatable to a maximum amount in either direction according to the angle between the flat portions.

In an embodiment the degree of rotation of the mast controls the compression and tension in the battens.

In an embodiment the leaches are moveable relative to each other such that one of the leaches is closer to the mast than the other.

In an embodiment the movement of the leaches is controlled by controlling the separation allowed between leach ends of the battens.

In an embodiment movement of the leaches controls the mean camber of the aerofoil.

In an embodiment the rigging further comprises a boom pivotally coupled to the mast at one end and which at another end the sail portions are coupled at a clew.

In an embodiment the amount of separation between the leaches is varied according to the length along the leach from the clew.

In an embodiment he boom is pivotal in a vertical plane, wherein the angle of the boom in the vertical plane is controllable and the angle of the boom in the vertical plane is configured to control the separation allowed between leach ends of the battens.

In an embodiment the boom is pivotal in a horizontal axis and rotation of the mast is adjusted relative to the longitudinal axis of the boom.

In an embodiment the boom is controllably articulated between its ends.

In an embodiment the mast is a spar and the sail is a headsail, wherein rotation of the spar is controlled relative to the deck of the boat.

In an embodiment the flat portion of the mast is formed by a mast pocket stretched between mast collars.

In an embodiment each sail portion is slidable along the length of the mast.

According to an aspect of the present, invention there is provided a rigging comprising:

a mast having a starboard side and a port side, wherein the mast is controllably rotatable in either direction about a longitudinal axis; a flexible sail comprising a starboard flexible sail portion and a substantially identical port flexible sail portion, each flexible sail portion having a luff and a leach, wherein the luff of each sail portion is connected to a respective side of the mast;

a plurality of elongated battens, each of which extends substantially between the luff and the leach of one of the respective sail portions, each of which is in contact with the respective flexible sail portion;

wherein the battens connected to one of the sail portions may be compressed along their length so as to bend one of the sail portions to increase the camber thereof and causes the battens connected of the other sail portions to be tensioned along their length so as to partly straighten the other sail portion which changes the shape of an aerofoil formed by the sail;

wherein the leaches are controllably moveable relative to each other such that one of the leaches is closer to the mast than the other.

According to an aspect of the present invention there is provided a rigging comprising:

a mast having a starboard side and a port side, wherein the mast is controllably rotatable in either direction about a longitudinal axis;

a flexible sail comprising a starboard flexible sail portion and a substantially identical port flexible sail portion, each flexible sail portion having a luff and a leach, wherein the luff of each sail portion is connected to a respective side of the mast;

a plurality of elongated battens, each of which extends substantially between the luff and the leach of one of the respective sail portions, each of which is in contact with the respective flexible sail portion;

wherein the battens connected to one of the sail portions may be compressed along their length so as to bend one of the sail portions to increase the camber thereof and causes the battens connected of the other sail portions to be tensioned along their length so as to partly straighten the other sail portion which Changes the shape of an aerofoil formed by the sail;

wherein leach end of battens are moveable relative to each other.

In an embodiment the relative displacement of each of the leach ends of the battens is controllable.

In an embodiment the relative displacement of the leach ends of the battens is automatically controlled by the angle of a boom to which the sail portions are attached.

In an embodiment the sail portions provide differing relative movement of corresponding portions of the leaches to each other, where the amount of relative movement is controlled according to the height of the leach portions from the deck.

According to an aspect of the present invention there is provided a rigging comprising mast pocket covering the mast and connected to sail portions forming either side of a wing sail, wherein the leading profile of the mast pocket is provided by a plurality mast collars for attachment of battens extending inside and in contact with the sail portions, such that the battens control the aerodynamic shape of the sail portions by increasing the camber of one of the sail portions according to a direction of rotation of the mast.

In an embodiment the mast collars profile the mast such that when the mast is rotated in one direction airflow passing from the mast to sail portion with the increased camber remains relatively attached to the sail portion.

According to an aspect of the present invention there is a mast collar for coupling to a mast, the mast collar rotatable with the mast and connected to on each side to a sail portion, the sail portions forming either side of a wing sail, the mast collar being configured for attachment of battens extending inside and in contact with the sail portions, such that the battens control the aerodynamic shape of the sail portions by increasing the camber of one of the sail portions according to a direction of rotation of the mast.

According to an aspect of the present invention there is provided a rigging comprising:

a mast having a starboard side and a port side, wherein the mast is controllably rotatable in either direction about a longitudinal axis;

a flexible sail comprising a starboard flexible sail portion and a substantially identical port flexible sail portion, each flexible sail portion having a luff and a leach, wherein the luff of each sail portion is connected to a respective side of the mast;

a plurality of elongated battens, each of which extends substantially between the luff and the leach of one of the respective sail portions, each of which is in contact with the respective flexible sail portion;

a boom pivotally coupled to the mast at one end and which at another end the sail portions are coupled at a clew, wherein the boom is controllably articulated between its ends;

wherein articulation of the boom causes the mast to rotate and then causes the battens connected to one of the sail portions to be compressed along their length so as to bend one of the sail portions to increase the camber thereof and causes the battens connected of the other sail portions to be tensioned along their length so as to partly straighten the other sail portion which changes the shape of an aerofoil formed by the sail.

According to an aspect of the invention there is a spreader between ends of the mast that is rotatable about an axis of rotation of the mast, such that the spreader is substantially stationary relative to the deck of the boat.

According to an aspect of the invention there is provide a wind propelled craft comprising the rigging described above.

In this specification the terms "comprising" or "comprises" are used inclusively and not exclusively or exhaustively.

Any references to documents that are made in this specification are not intended to be an admission that the information contained in those documents form part of the common general knowledge known to a person skilled in the field of the invention, unless explicitly stated as such.

DESCRIPTION OF DRAWINGS

In order to provide a better understanding of the present invention embodiments will now be described may be described, by way of example only, with reference to the drawings, in which:

FIG. 19 is an oblique view of battens of the sail of FIG. 2;

FIG. 20A is a schematic diagram showing a leach control line running along the battens of FIG. 19 in a port setting;

FIG. 20B is a schematic diagram showing a leach control line running along the battens of FIG. 19 in a starboard setting;

FIG. 30A is a side elevation of a configuration of shrouds which support spreaders on the rotating mast of FIG. 2;

FIG. 30B is a front view of the configuration of FIG. 30A;

DESCRIPTION OF EXAMPLE EMBODIMENTS

Figure 1:
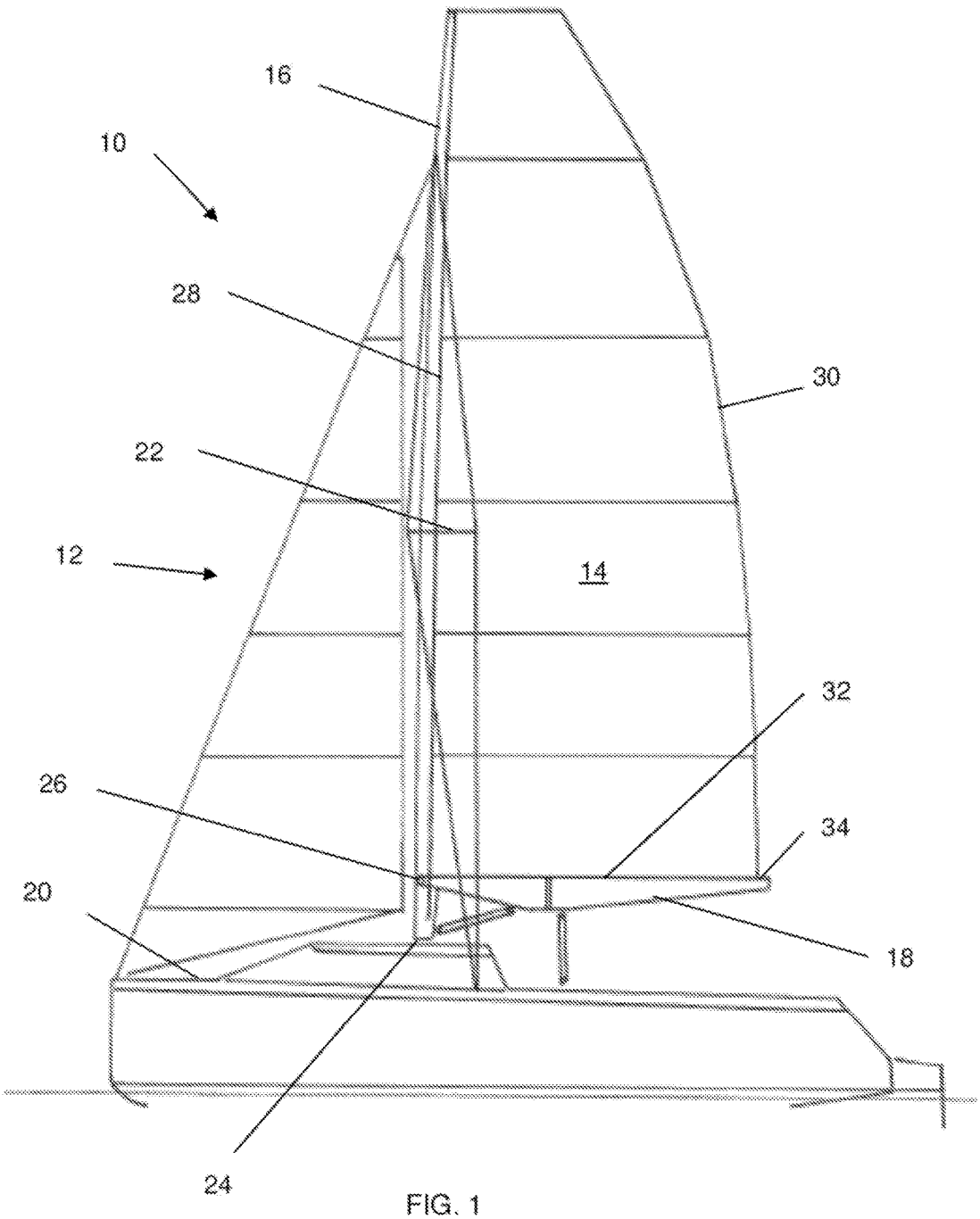
FIG. 1 is a side elevation of a sailing vessel having rigging according to an example embodiment of the present invention.
Figure 2:
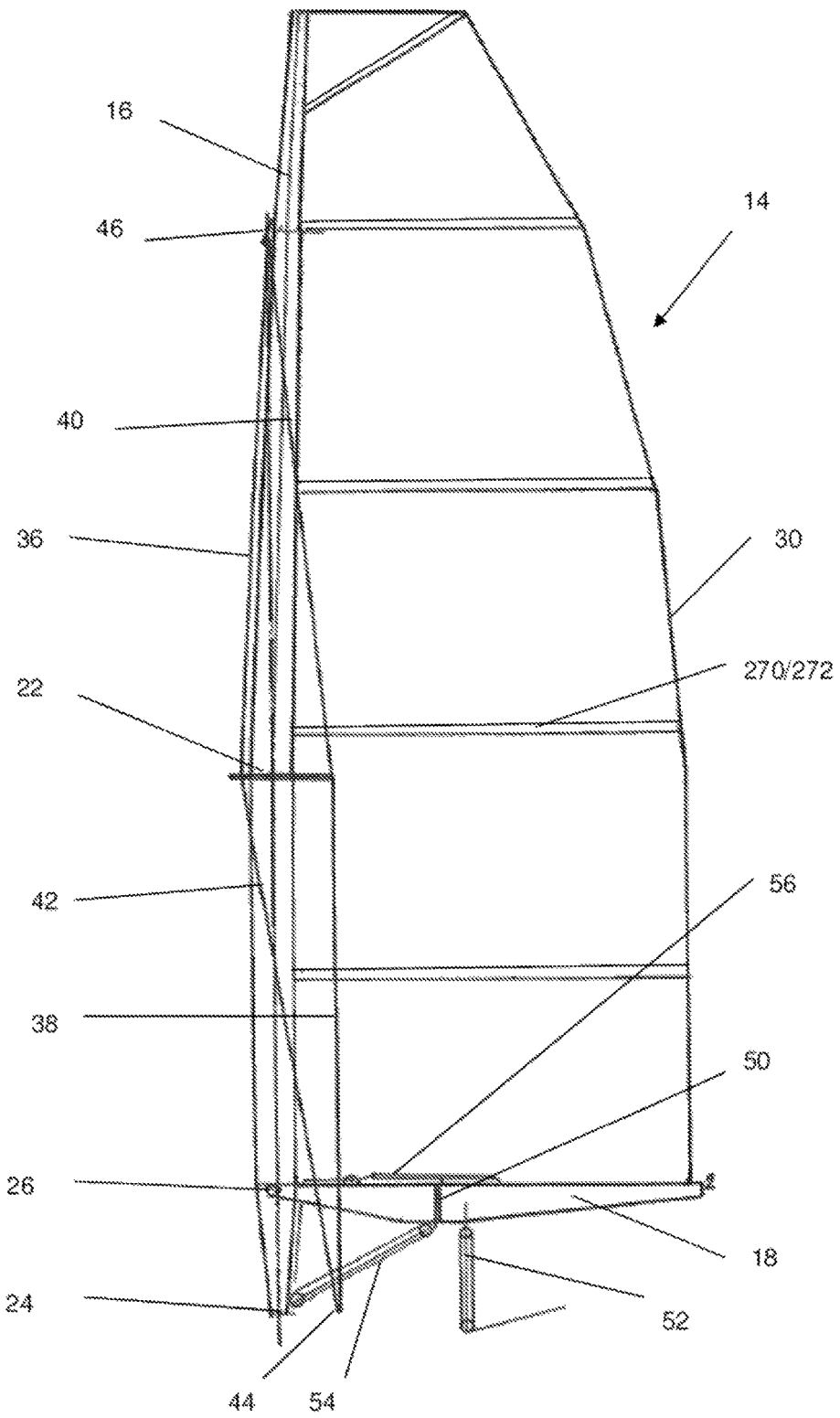
FIG. 2 is a side view of the rigging of FIG. 1, including a wing sail.

Referring to FIGS. 1 and 2 there is shown a sailing vessel 10 comprising a deck 20 and a rigging 12 according to an embodiment of the present invention. The rigging 12 comprises a wing sail 14, a mast 16 and a boom 18. The mast 16 is connected to the deck 20 or other part of the vessel 10 (such as a cabin) by connection 24. The boom 18 is connected to the mast 16 by a gooseneck 26. In an embodiment the mast 16 is supported by guy lines in the forms of stays or shrouds 36, 38, 40 and 42 supported part-way up the mast by a spreader 22.

Figure 3:
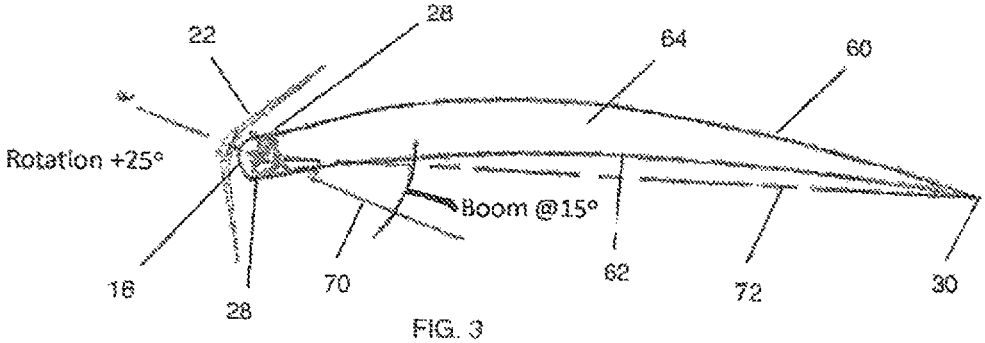
FIG. 3 is a section view of the wing sail rotated to give a port tack setting.

Referring to FIG. 3 the wing sail 14 comprises port and starboard substantially identical sail portions 60 and 62, each of which have a luff 28 and leach 30. The sail portions 60 and 62 are connected to the boom 18 at a clew 34 of the foot 32 of the sail 14.

The wing sail 14 is rotated to give a port tack setting. The boom 18 is set to an angle of 15 degrees between axis 72 of boom 18 and the longitudinal axis 70 of the vessel 10. The mast 16 is rotated clockwise by 10 degrees relative to the longitudinal axis of the boom 18.

In this instance the rotation of the mast is actually 5 degrees from the longitudinal axis of the vessel. This will change with the sheeting angle. The asymmetry of the sail is, in this embodiment, fixed relative to the boom 18. Thus changing the sheeting angle (or angle of attack) does not change the wing geometry. This is important where the wing sail 14 is a mainsail as the sheeting angle changes can be large and frequent, whereas, if it is deployed as a headsail, the angle changes are typically smaller and much less frequent and hence adjusting the spar rotation relative to the vessel 10 may be an effective solution. In fact, as the headsail sheeting angles are typically in the order of 6-12 degrees, it is possible that the spar would require only small adjustment from tack to tack. In such an embodiment the mast is a spar for the headsail and rotation of the spar is controlled relative to the deck of the boat.

Between the sail portions 60 and 64 is a cavity 64. The sail is shaped by a plurality of elongated battens (270 and 272 in FIG. 20), each of which extends substantially between the luff 28 and the leach 30 of one of the respective sail portions 60 and 64. Each of the battens is in contact with an inside surface of the respective sail portion 60 or 64. Each of the battens is pivotally connected to a respective starboard or port side of the mast 16 as described in more detail below.

The rotation of the mast 16 relative to the boom 18 causes the battens connected to one of the sail portions (in this case starboard sail portion 60) to be compressed along their length so as to bend the starboard sail portion 60 to increase its camber. Rotation of the mast 16 relative to the boom 18 also causes the battens connected of the port sail portion 62 to be tensioned along their length so as to partly straighten the port sail portion 62 which decreases at the connection to the mast, but further from the mast increases, the perpendicular distance between the sail portions 60 and 62, thus changing the resulting shape to increase the asymmetry of an aerofoil formed by the sail 14. In particular. the deflection of the starboard batten moves the batten away from the mean camber line. Note, that the aerodynamic forces on the sail portions with tend to pull the starboard batten out and push the port batten in, thus assisting the battens in deflecting in the correct direction.

Air flow travelling over the starboard sail portion 60 (from left to right of the page) has further to travel than the air flow over the port sail portion 62, which induces aerodynamic lift to the wing sail 14, which in turn propels the vessel 10.

Figure 4:
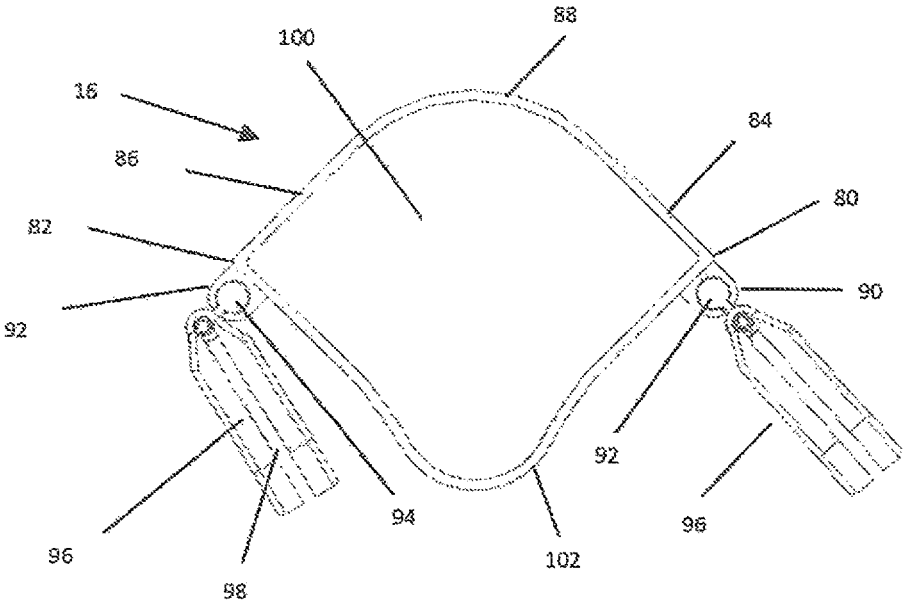
FIG. 4 is a horizontal sectional view of a mast with port and starboard batten slide assemblies.

Referring to FIG. 4 a cross section of the mast 16 has profiled windward face that is about twice as broad as it is proud. The profile is symmetrical about a central axis and has a starboard 80 side and port 82 side. The profile comprises substantially flat portions 84 and 86 at an angle to each other. The flat portions 84 and 86 may have a slight convex curve. Each flat portion 84 and 86 ends in a corner on one of the sides and at which the respective flexible sail portions 60 and 62 are connected by slide connections. Between the flat portions 84 and 86 is a convex curved portion 88. The mast has a aft-ward profile 102 to increase the forward-aft dimension of the mast so as to increase its moment of inertia in that direction and to provide clearance between for the batten assembly 96 and the profile 102 when the sail portion is in tension (in this case port side). When the mast 16 is rotated in one direction the surface of the flat portion on the side with the sail portion having the resulting increased camber (in this case flat portion 84) and the surface of the that sail portion (in this case portion 60) have a relatively flat air flow over these surfaces. Thus the airflow passing from the mast 16 to sail portion 60 remains relatively attached to the sail portion 60.

The interface between the mast 16 and the sail portion that is partly straightened (in this case the interface between flat portion 86 and port sail portion 62) comprises an acute angle. This shape creates an unfavourable corner at the sail-mast juncture on the windward side of the sail 14. To minimise the impact of this effect (which is most apparent at angles of incidence below 7-8 degrees) the junction between the sail 14 and mast 16 should create a somewhat rounded profile or non-sharp corner. This junction may not be aerodynamically smooth but the "imperfections" created by the sail and mast junction should be relatively small in dimension such that the air flow only a few millimetres from the surface is smooth and that separated airflow reattaches relatively close to the mast 16. Further due to the profile 102 air is not encouraged to flow into the cavity 64. To achieve this the air gap between the luff and the mast track 92 should be kept small—only a few millimetres.

In an embodiment the angle between the flat portions is between 60 and 100 degrees, preferably between 70 and 95 degrees and most preferable about 90 degrees. In an embodiment the mast is proud of the corners by between 35% and 60% of the distance between the corners of the mast 16. Preferably these amounts are between 40% and 50% and most preferably about 50%.

It is desirable that the junction between the flat portion of the mast on the leeward side and the sail on the leeward side is very slightly less than 180 degrees. Generally it is undesirable for the angle to be greater than 180 degrees due to the adverse pressure gradients developed being such that re-attachment of the separation bubble formed on the flat part of the mast does not reattach. An angle of less than 180 degrees causes an increase in pressure at that point such that the separation bubble is prevented from propagating further along the sail. At this point there is then reattachment of a turbulent boundary layer. The critical angles are not fixed and are dependent upon wind speed, and angle of attack of the foil, among other things.

Because the clew of the sail is attached to the boom, the amount of tension applied to the sail along the boom is also important as this controls the distance between the clew and the mast. This in turn affects the amount of camber that is introduced in the sail. This camber is induced by: the action of the wind loads; by physically pulling the clew towards the mast (in-hauling); or by curvature induced by a difference between the curvature of the mast along its span (or longitudinal axis) relative to the curvature of the sail panels along the luffs. Rotation of the mast will then further increase the compression in the leeward sail portion and increase the tension in the windward sail portion, inducing a difference in camber relative to this already induced camber such that the leeward side is more cambered and the windward side is less cambered.

It is desirable in some circumstances (such as with high angles of attack, as when sailing off the breeze) to increase mast rotation to reduce the angle between the mast and the sail portion to provide better pressure gradients to encourage reattachment of the separation bubble.

In an embodiment the surface of the flat portion on the side with the sail potion having the resulting increased camber and the surface of the that sail portion have the air flow there-over that is most flat substantially before a maximum rotation of the mast in that direction. This can allow over-rotation such that the leeward side angle between the flat portion and the sail portion is less than 180 degrees, as this can be beneficial in certain circumstances.

When the wing sail 14 is rotated to give a starboard tack setting the mast 16 can be rotated in anti-clockwise to provide mirrored asymmetry of the aerofoil formed by the sail 14 to that described above. In other words this allows swapping the asymmetry from port to starboard or vice versa as required by the direction of the tack.

The mast section and sail slide configuration shown in FIG. 4 provides a good aerodynamic compromise while allowing the sail to be configured for both port and starboard operation.

Thus the shape of the mast section has a relatively clean aerodynamic shape that is achieved on both port and starboard settings. The shape of the mast is such that, when rotated to induce asymmetry in the wing section by compressing one set of elongated battens on the leeward side of the sail and tensioning the opposite set of elongated battens on the windward side of the sail, no significantly adverse pressure gradients are formed in the air flowing around the sail that would cause substantial separation of the air flow (i.e. separation without reattachment) and hence a significantly detrimental loss of aerodynamic lift. Convex curvature, for example where the mast is a semi-circular section forward of the sail attachment points, causes there to be a sufficiently large drop in pressure on the leeward side of the sail just prior to the sail attachment points such that the boundary layer does not reattach. By flattening the mast section as it leads to the sail attachment point, the pressure gradient is reduced to the extent that, while there is still some separation of the flow, it re-attaches very quickly with minimal reduction in aerodynamic lift.

An additional and not inconsiderable advantage is that a mast of this general shape has a relatively high moment of inertia as it is large in cross section, but with low aerodynamic drag as the mast essentially becomes part of the wing. Note that on a conventional mast the aerodynamic penalty of the mast being at the leading edge of the sail is significant.

Figure 5:
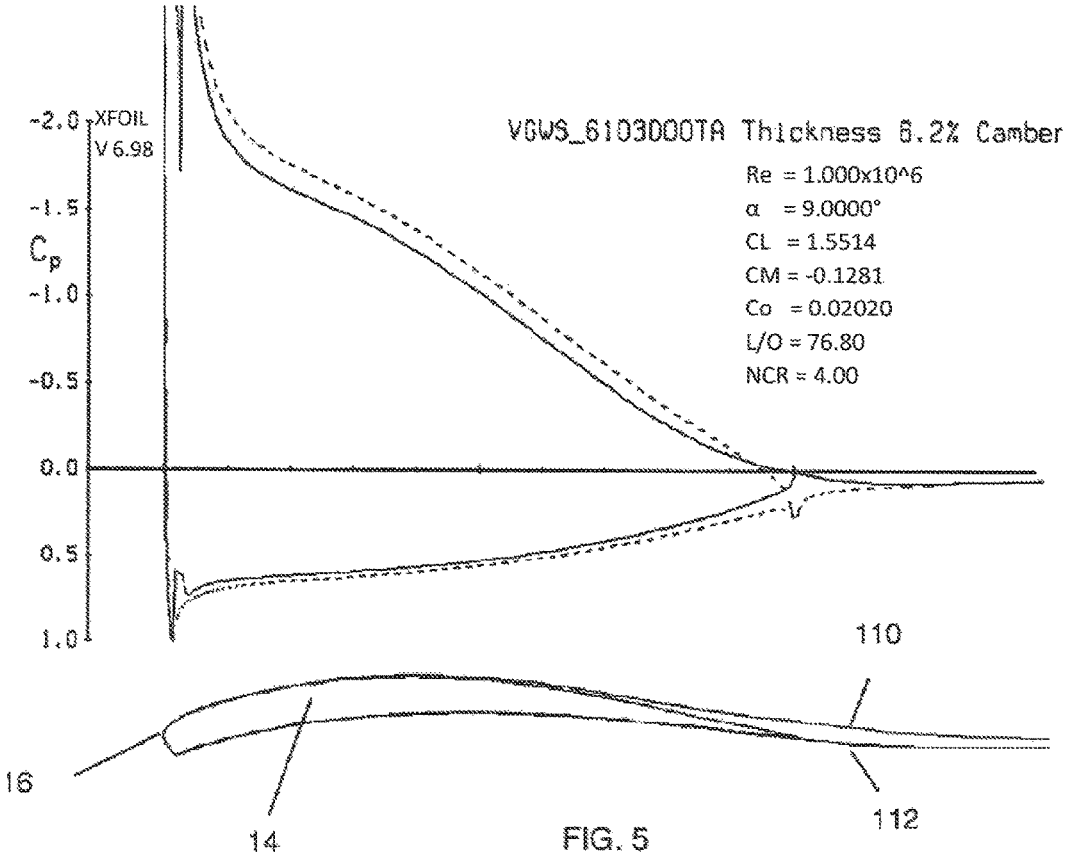
FIG. 5 is a screen capture from Xfoil CFD software showing performance of a wing sail according to an embodiment of the present invention.

The screen capture from Xfoil in FIG. 5 shows the pressure co-efficient and boundary layers for a mast set with 10 degrees of rotation at 9 degree angle of incidence.

Figure 6:
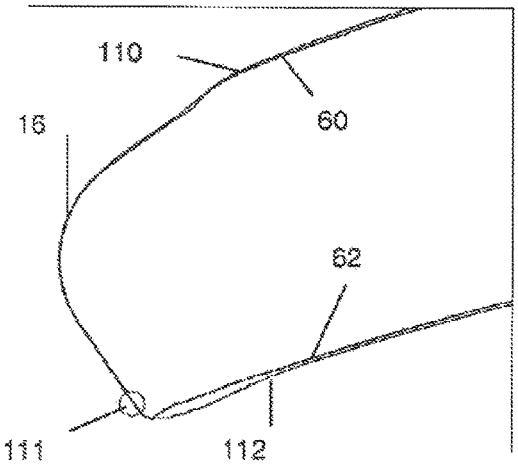
FIG. 6 is an enlargement of the screen capture of FIG. 5.
Figure 7:
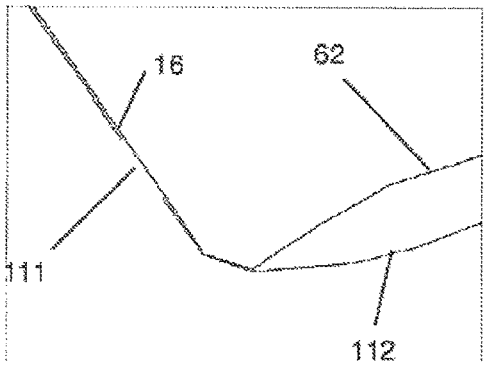
FIG. 7 is an enlargement of the screen capture of FIG. 6.

The screen captures in FIGS. 6 and 7 show the boundary layers for the windward corner of the mast set with 10 degrees of rotation at 9 degree angle of incidence. This shape is similar to the shape shown for the windward corner in FIG. 4. The stagnation point is indicated by circle at 111. The increase in distance between the windward boundary layer 112 and the sail surface 62 indicates a region of separation behind the mast sail juncture.

Figure 8:
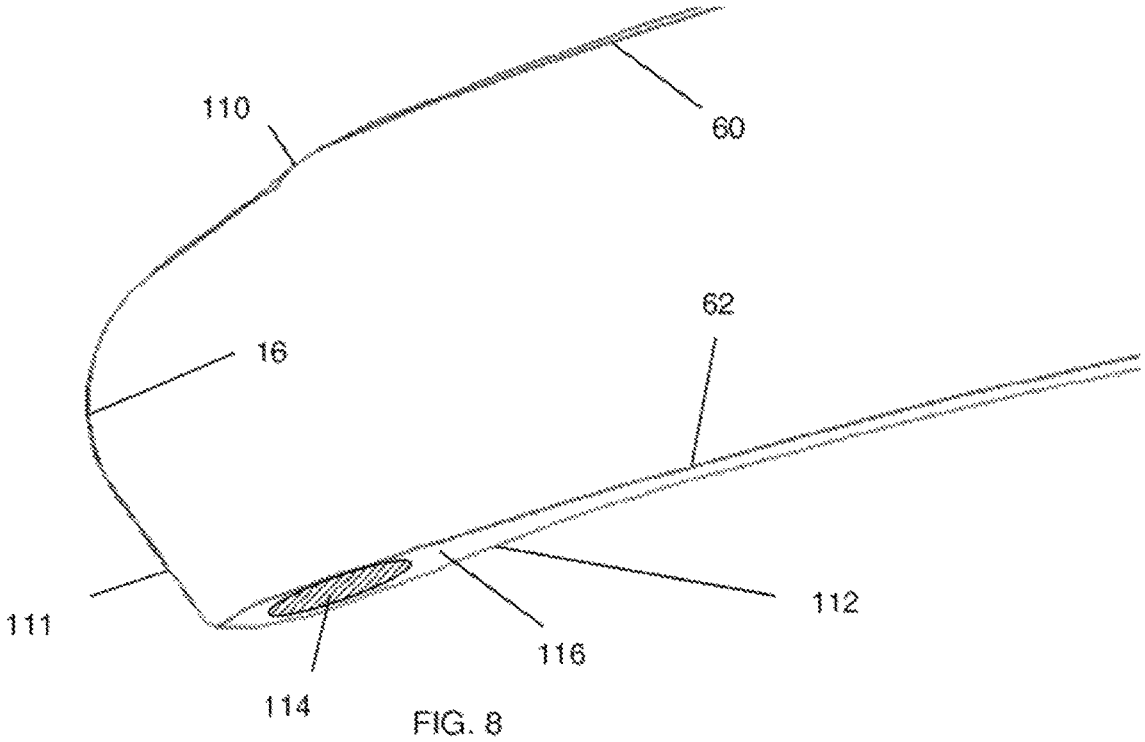
FIG. 8 is a screen capture from Xfoil CFD software showing performance of a wing sail according to an embodiment of the present invention.
Figure 9:
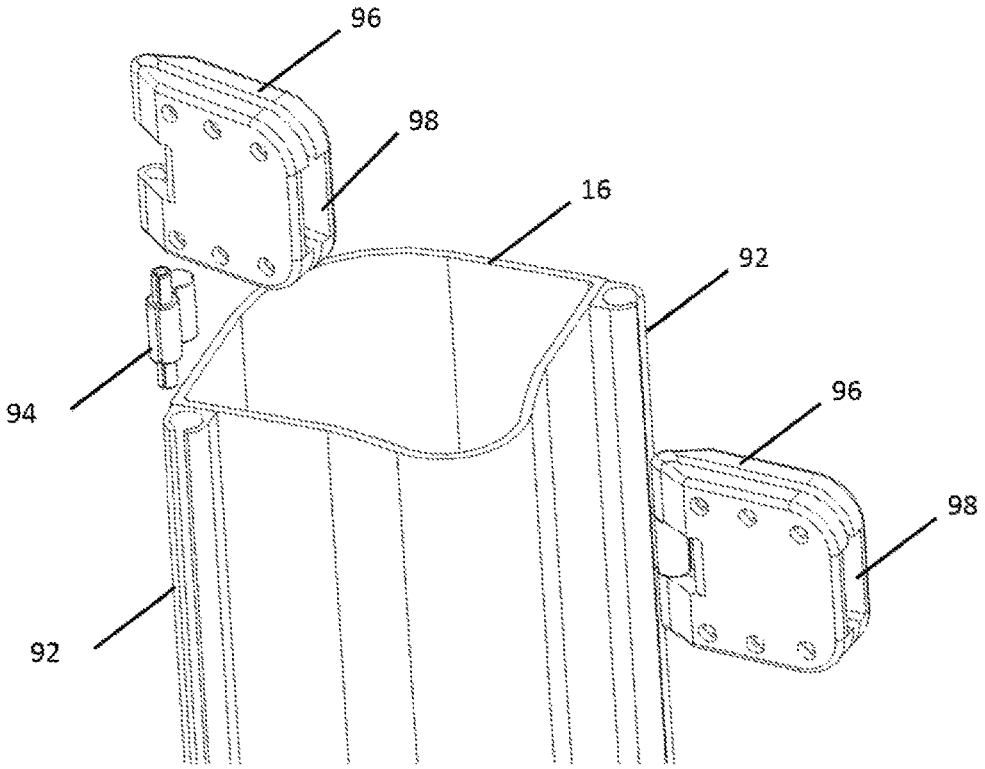
FIG. 9 is an oblique view of the mast of FIG. 4, with a port side batten assembly in exploded view.

The screen capture from Xfoil in FIG. 8 shows the boundary layers for the windward corner of the mast set with 10 degrees of rotation at 7.5 degree angle of incidence. This image shows an increase in distance between the windward boundary layer 112 and the sail surface 62 both aft of the mast sail juncture and further along the sail. Reducing the angle of attack below 7.5 degrees (for this set of conditions) will result in significant separation on the windward side and hence loss of aerodynamic performance.

Region 114 has been added to the screen capture to show an airflow separation bubble created by the corner at the intersection between the flat portion of the mast and the luff. It is desired for this separation bubble to be as short as possible so that at its end 116 the airflow reattaches to the sail portion. The rounded shape of this corner is able to shorten the length of the separation bubble.

A small separation bubble at this corner is advantageous where a slide configuration is used on the luff. In this case it is desirable that the luff of the sail does not protrude through the separation bubble. If the luff protrudes through the separation bubble there will be a significant increase in the air wanting to flow into the cavity. While this is minimised by keeping the air gap small, if the luff is in the separation bumble there is little tendency for flow into the cavity.

Figure 10A:
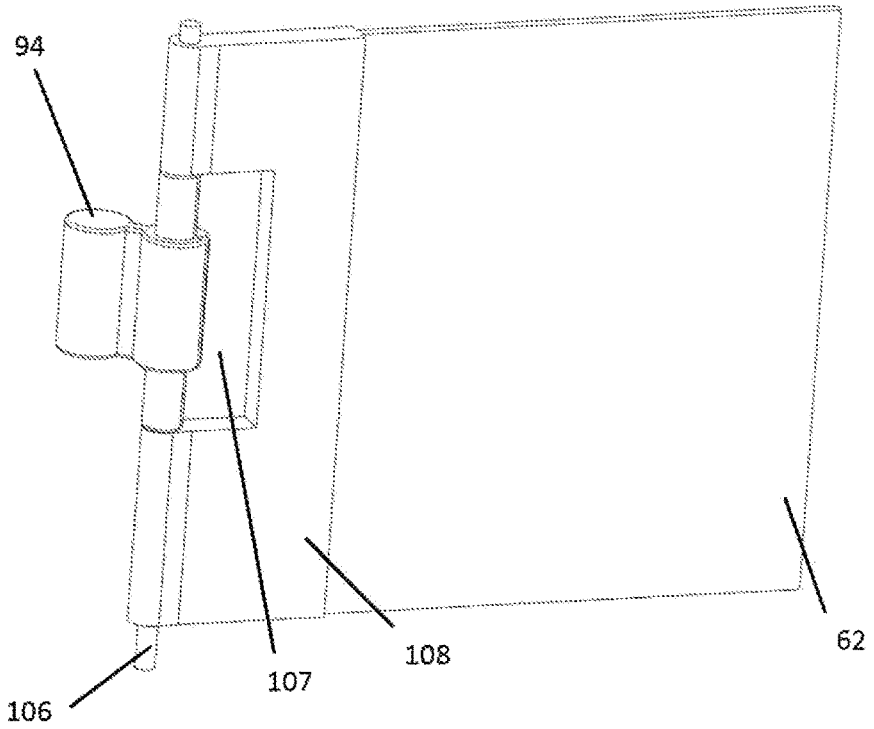
FIG. 10A is an partial oblique view of a luff portion of a port wing sale portion with a cut out in the luff tape of the sail portion and luff rope with a sail slide fitted to the luff rope according to an embodiment of the present invention.
Figure 10B:
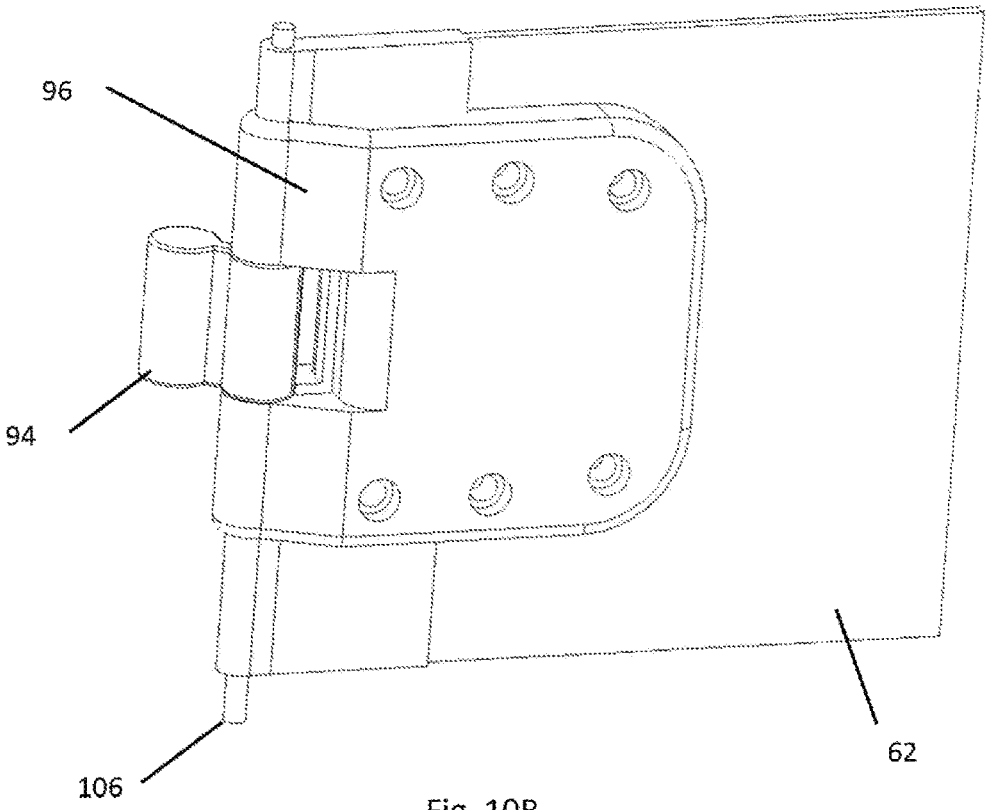
FIG. 10B is a partial oblique view of the luff portion of FIG. 12 with a luff end batten receptacle fitted.

Referring to FIGS. 4, and 9, 10A and 10B, the sail portions 60 and 62 are connected to the mast 16, on each side 80 and 82 by slides comprising a track 92 in which there is a longitudinally extending groove that holds a slider pin 94 captive. As seen in FIG. 10A, the slider pin 94 is fitted over and pivotally coupled to a luff rope 106 that is connected to the luff 28 of the respective sail portion 60/62 by luff tape 112 and is continuous along the length of the luff of each sail portion 60/62.

Thus the sail slide 94 is articulated close to the sail track 92 so as to ensure that the shape referred to above is obtained. This is important as a substantial (more than a few millimetres) separation between the mast and sail portions 60 and 62 results in an undesirable airflow into cavity 64 between the two sail portions effectively inflating the sail 14 and creating an undesirable aerodynamic shape with low lift and high drag.

Extending either side of the slider pin 94 and over the luff tape 112 is a side batten assembly 96 that attaches to the sail portion and receives the luff end of one of the battens in slot 98.

An alternative to use of a slider is to use a bolt rope.

The sails portions 60/62 and hence necessarily the elongated battens are fixed directly to the mast at the luff 28 and not via a control rod as is the case in U.S. Pat. No. 4,766,831.

Further the mast is not in a two piece mast configuration (mast and control rod) as described in U.S. Pat. No. 4,766,831.

Figure 11:
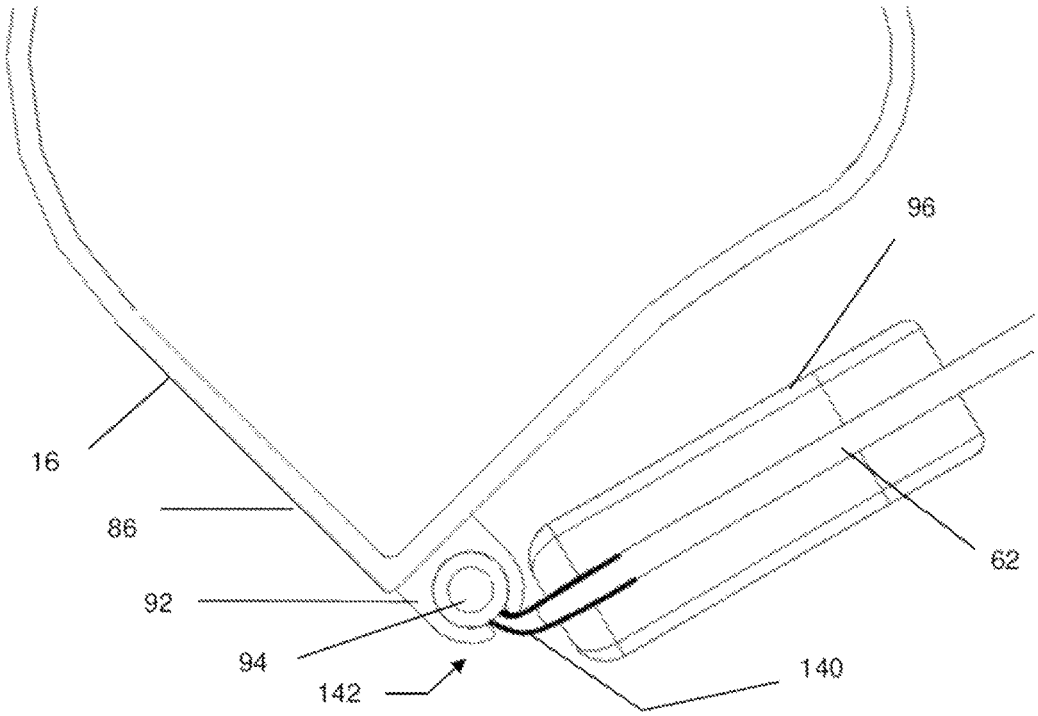
FIG. 11 is a partial horizontal cross section of the mast of FIG. 4, with an alternative attachment structure of the port sail portion.

FIG. 11 shows an alternative attachment mechanism in which a webbing hinge 140 is used instead of the rigid hinge of FIG. 4. Here the webbing 140 still attached to a slider 94 which is received in the groove of track 92. The flexibility of the webbing 140 will allow the batten assembly 96 to be set back slightly further thus smoothing or rounding this corner 142 somewhat so as to position the luff 28 inside the separation bubble 114. The extent to which the corner 142 is rounded is a compromise because rounding the corner on the leeward side is undesirable.

In accordance with a further aspect of the present invention a smaller or standard mast 250 may be encapsulated in a pocket 300 which extends up the luff so as to form mast 16 that joins the two flexible sail portions 60/62 together with the shape of the leading edge of the aerofoil section being formed by mast collars 200 which are substantially similar in section as the mast section described above being fitted to a smaller mast section 250.

In this way a standard mast 250 may be retrofitted with a plurality of mast collars 200 and pocket 300 so as to operate as the mast 16 described above. A more flexible fabric can be used to join the two sail portions 60/62 to ensure a taught skin is stretched between the collars.

Figure 12:
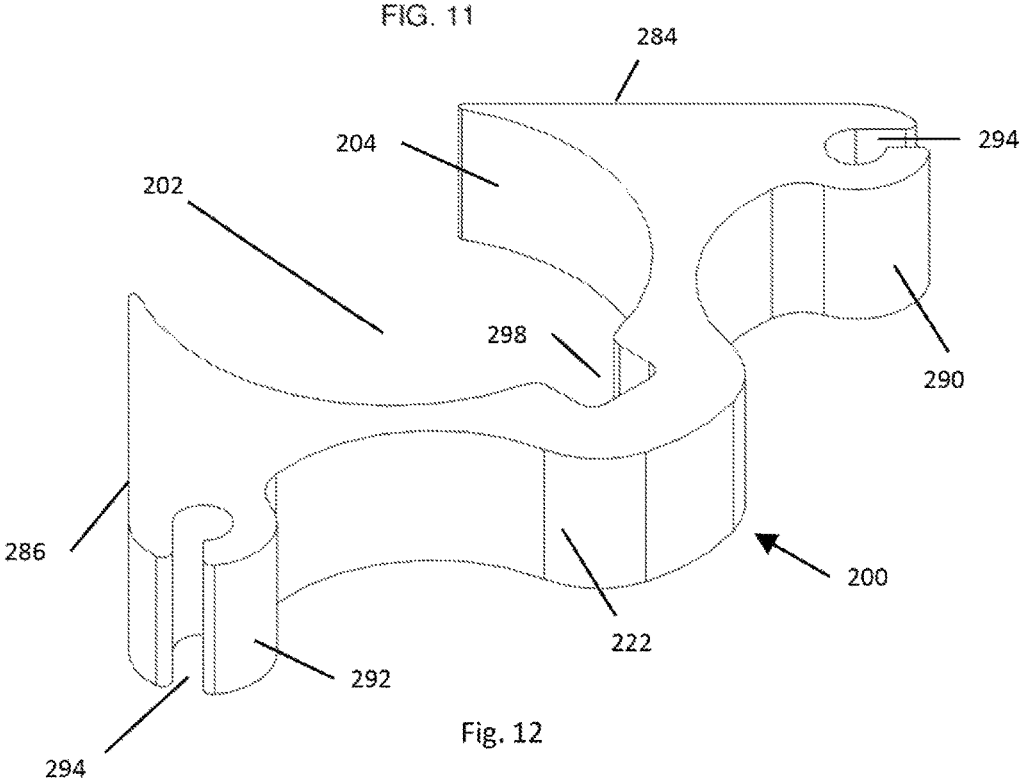
FIG. 12 is an oblique view of a mast collar according to an embodiment of the present invention.
Figure 13:
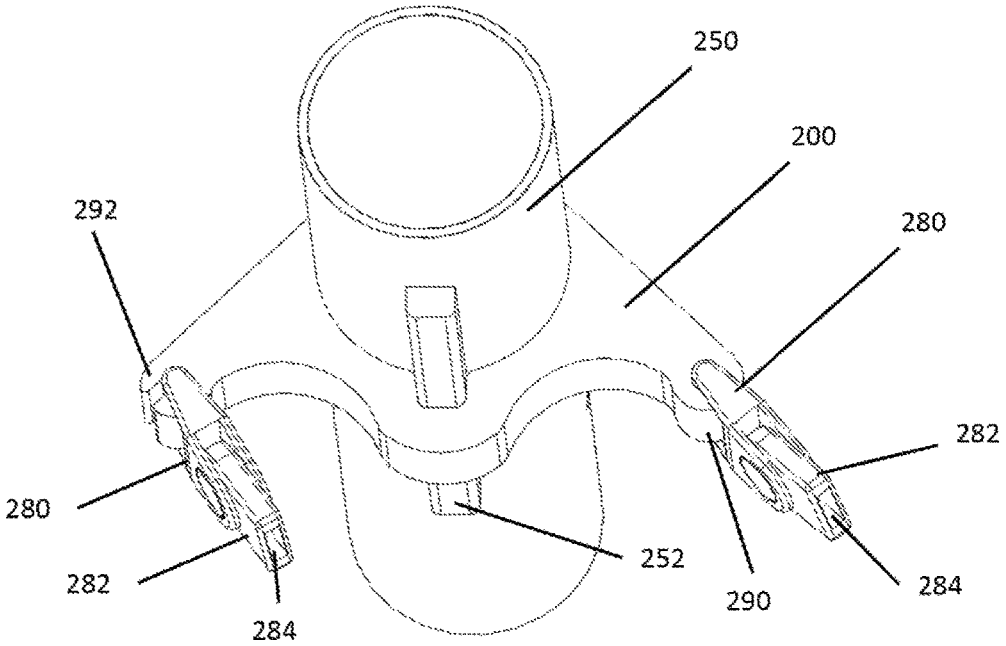
FIG. 13 is an oblique view of an assembly of the mast, mast key, mast collar of FIG. 12 and batten ends according to an embodiment of the present invention.

Referring to FIGS. 12 and 13, the mast collar 200 has a body with a windward channel 204 having an opening and void 202 for receiving and holding captive a circular mast 250. The channel has a keyway 298 for receiving a key or tab 252 attached to the mast so that the collar 200 is unable to rotate about the longitudinal axis of the mast 250. The body of the collar 200 also has port and starboard lobes at outward extremities so as to provide the substantially flat portions 284 and 286. The lobes end in channel portions 290 and 292 to which batten connectors 280 are pivotally attached. The batten connectors 280 have pivotal batten hinge fittings 282 with batten receptacles 284 for receiving the luff end of the battens 270/272.

In an embodiment the mast collars are substantially larger across the aft-ward part of the collar than the diameter of the mast as shown.

In an embodiment the batten connector 280 comprises an articulated join 288 to provide the pivotal connection to the hinge fittings 282 which allow for the battens to be aligned non-perpendicular to the mast 250. The connections 280 have a post 286 spaced by a gap 285 from the join 288. The post 286 is received in the channel 294 of the channel portions 290/292 and each of the channel portions 209/292 passes through the gap 285 so as to grasp the post 286.

Figure 14:
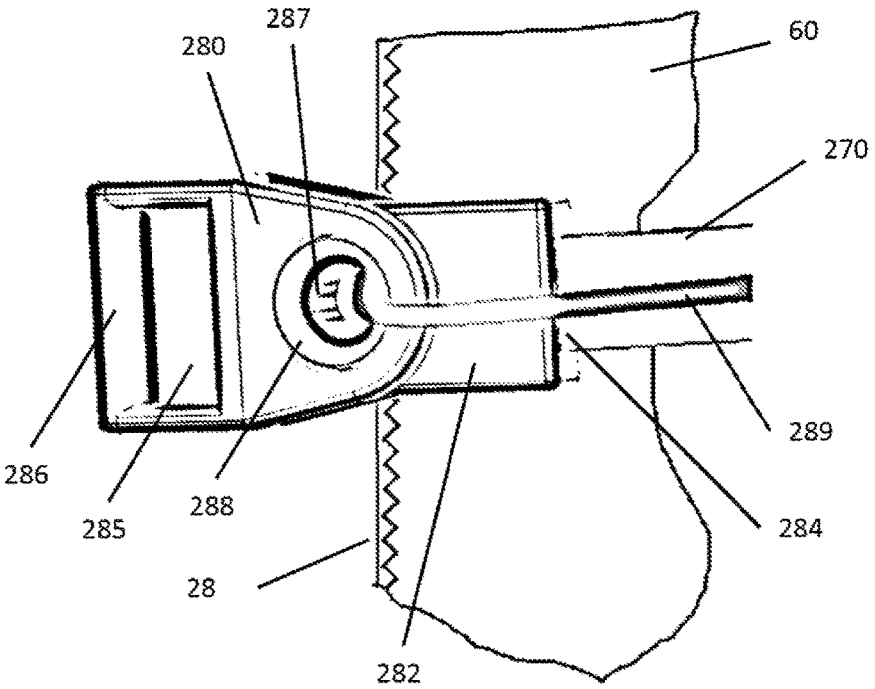
FIG. 14 is an oblique view of a batten end fitting which fit into the collar of FIG. 13, with a cord attaching the sail portion to the batten fitting.

As shown in FIG. 14 in an embodiment the hinge fitting 282 provides a means such as hole 287 by which the hinge fitting 282 can be fixed to the luff 28 of the sail portion via a cord 289 which passes through the axis of the articulation of the hinge fitting 282.

Figure 15A:
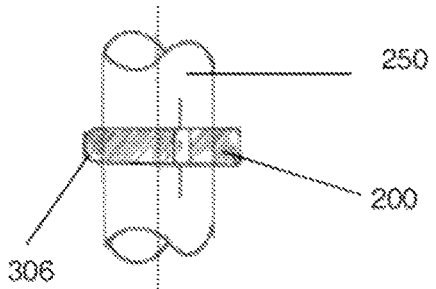
FIG. 15A is a side profile of a mast fitted with a collar according to an embodiment of the present invention.
Figure 15B:
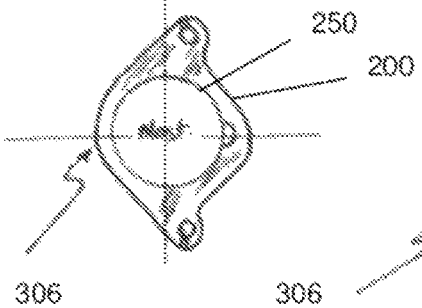
FIG. 15B is a horizontal cross section of the mast and collar of FIG. 15A.
Figure 15C:
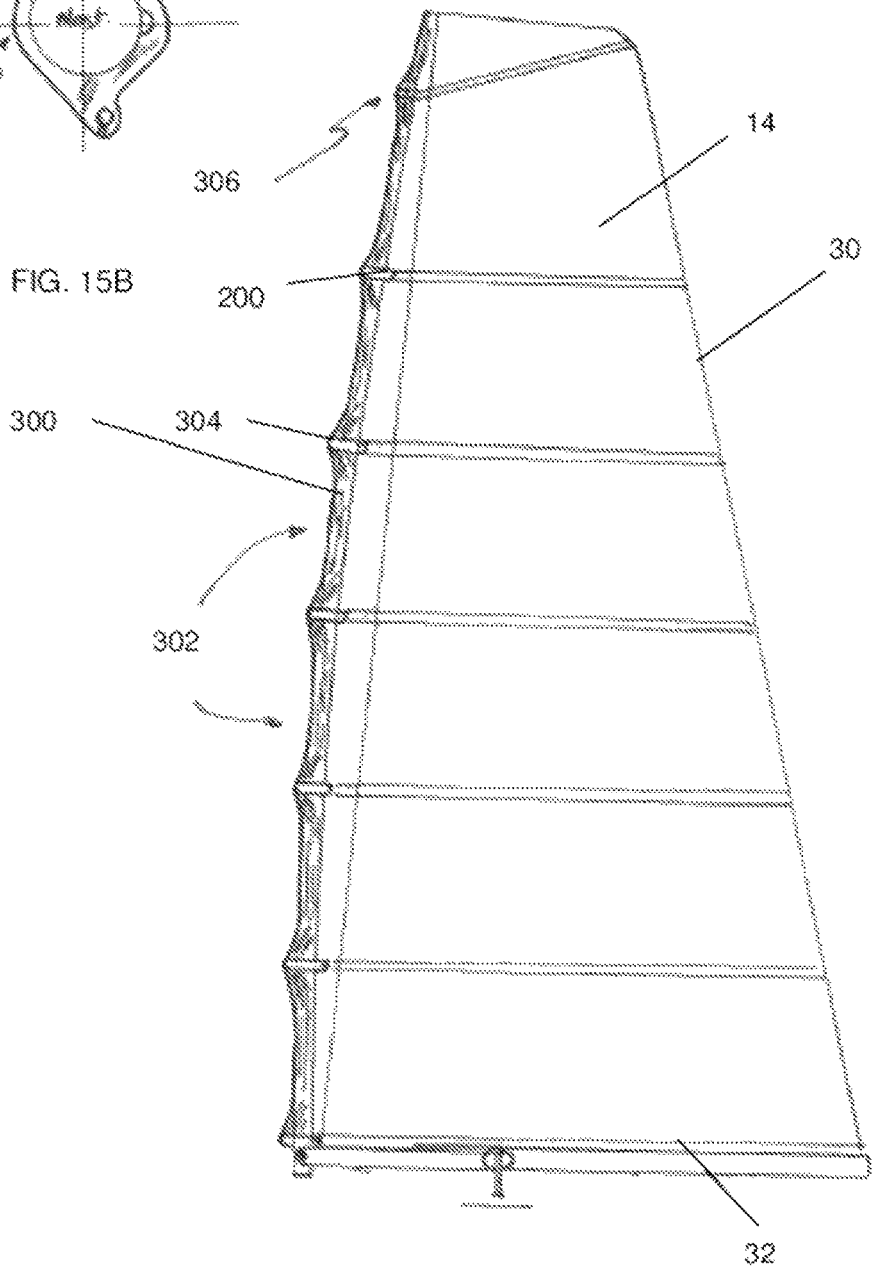
FIG. 15C is an elevation of the a sail including the mast and collars of FIGS. 15A and 15B according to an embodiment of the present invention.

As shown in FIG. 15A to 15C, in an embodiment the leading edge can be formed by the luff pocket 300 being stretched tightly between the mast collars 200 by tension on the luff 28, foot 32 and along the battens 270 and 272.

The mast collars 200 can extend laterally (substantially perpendicular to the masts longitudinal axis) in front of the mast 250 so as to form a projection 306 from the mast 250. When the luff pocket 300 is stretched over the mast collars 200 a corrugated effect is produced by the projections 306, the corrugated effect forming leading edge tubercles 304 which are known to have beneficial effect on the aerofoils lift, drag and angle of stall.

In an embodiment the luff pocket 300 is joined longitudinally by (for example) a zip such that the two flexible sail portions 60 and 62 can be separated for manufacture or repair.

According to another aspect of the invention, battens are not rigidly fixed together at the leach.

According to an aspect of the present invention the leaches of the sail portions 60/62 are moveable relative to each other such that one of the leaches is closer to the mast 16 than the other according to the height of the leach from the clew. This allows the sail to twist. Further control of the position of the leaches allows control of the aerofoil profile according to the height of the battens.

It is desirable to allow span-wise twist to account for an increasing angle of attack on the wing towards the top due to windshear, where wind at the bottom of the wing sail 14 is slower than wind at the top of the sail 14. The apparent wind seen by the sail 14 is the vector sum of the vessel velocity and the wind velocity and hence the angle is greater at the top.

Figure 16:
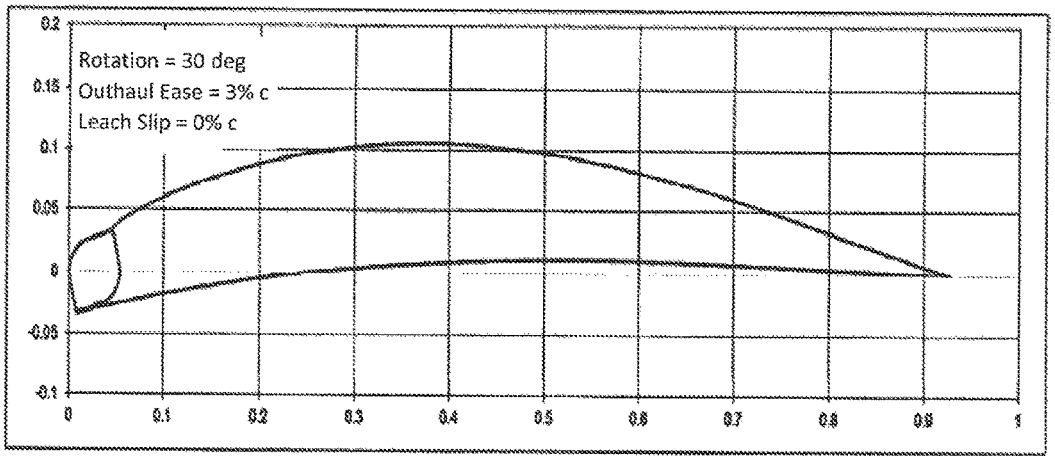
FIG. 16 is a screen capture of a horizontal cross section of a sail according to the present invention with the mast rotated to 30 degrees by (say) 15 degrees of rotation and 15 degrees of sail twist.
Figure 17:
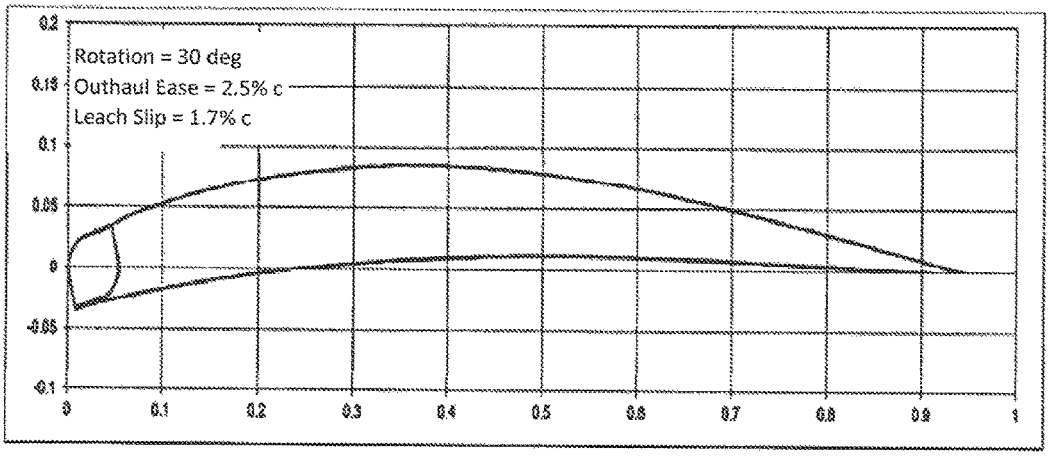
FIG. 17 is a screen capture of a horizontal cross section of a sail according to the present invention with the mast rotated to 30 degrees but the leaches allowed to slip 1.7% of the chord length.
Figure 18:
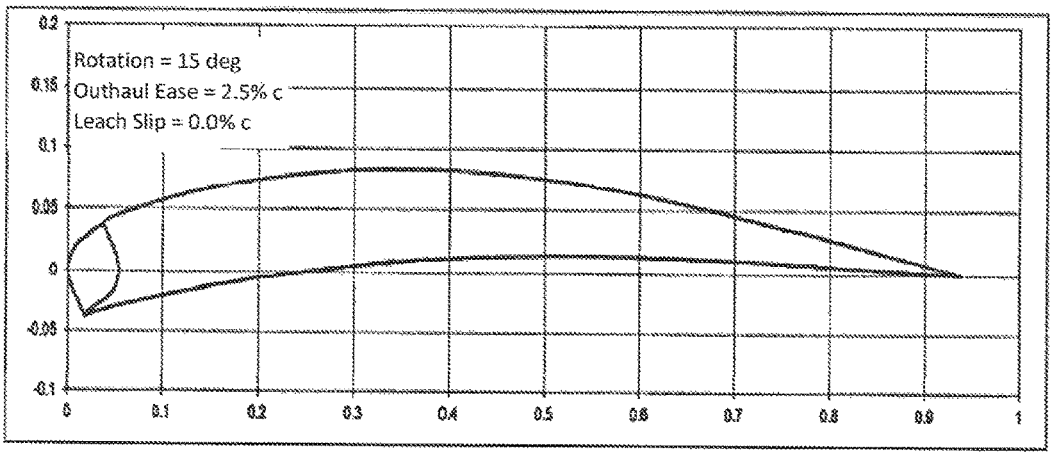
FIG. 18 is a screen capture of a horizontal cross section of a sail according to the present invention with the mast rotated to 15 degrees with no slip at the leach.

FIG. 16 shows the mast rotated to 30 degrees by (say) 15 degrees of rotation and 15 degrees of sail twist. FIG. 17 shows the mast rotated to 30 degrees but the leaches allowed to slip 1.7% of the chord length. The slip is evident at the leach of the sail. FIG. 18 shows the mast rotated to 15 degrees with no slip at the leach. Note how this section is substantially similar to the one in FIG. 16.

FIG. 19 shows a pair of battens 270 (starboard) and 272 (port), each with a fitting 320 and 322 at the leach end. The fittings 320/322 are for fitting to webbings of the starboard sail portion 60 and webbings of the port sail portion 62, respectively. The fittings have a hole or slot for a control line 270 to be attached. Thus the leach ends of battens are moveable relative to each other. Further the leaches of the sail portions 60 and 62 are moveable relative to each other. Sail portion 62 is translucent in FIGS. 19 and 21.

The sail portions 60 and 62 have batten pockets 350 and 352 for receiving battens 270 and 272, respectively.

A batten control line 330 runs along the batten pocket 350 in one sail portion (in this case sail portion 60). This control line 330 passes through the leach end of the batten at fitting 320 and extends to the other fitting 322 where it is then terminated at the end of the other batten.

FIGS. 20A and 20B show port and starboard settings, respectively, of the leach control line 330 running along the batten 270, through the batten end fitting 320 and to the batten end fitting 322 of the other batten 272. The sail portions 60 and 62 are shown with slip relative to each other at the leach 30 on a port tack setting. Cord 289 connects the leach of the sail portion 60/62 to the batten 322. Connecting loop 344 connects the cords 289 to hold the sail portions 60 62 together.

Figure 22:
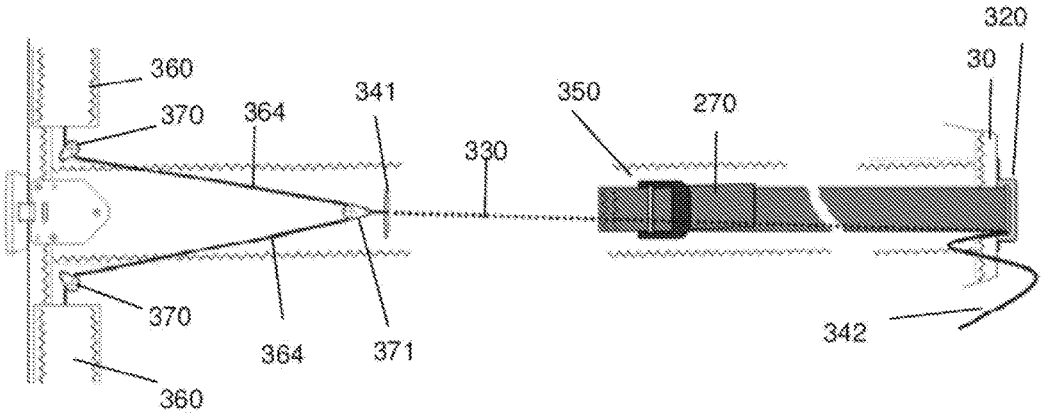
FIG. 22 is a schematic diagram showing the leach control line of FIGS. 20A and 20B running along a batten pocket and through an end of the batten.

FIG. 22 shows the leach control line 330 runs through a pocket opening 341 into and along the batten pocket 350 and through the end of the batten fitting 320. The line 342 is connected to the end of the corresponding batten on the other sail portion.

Figure 23:
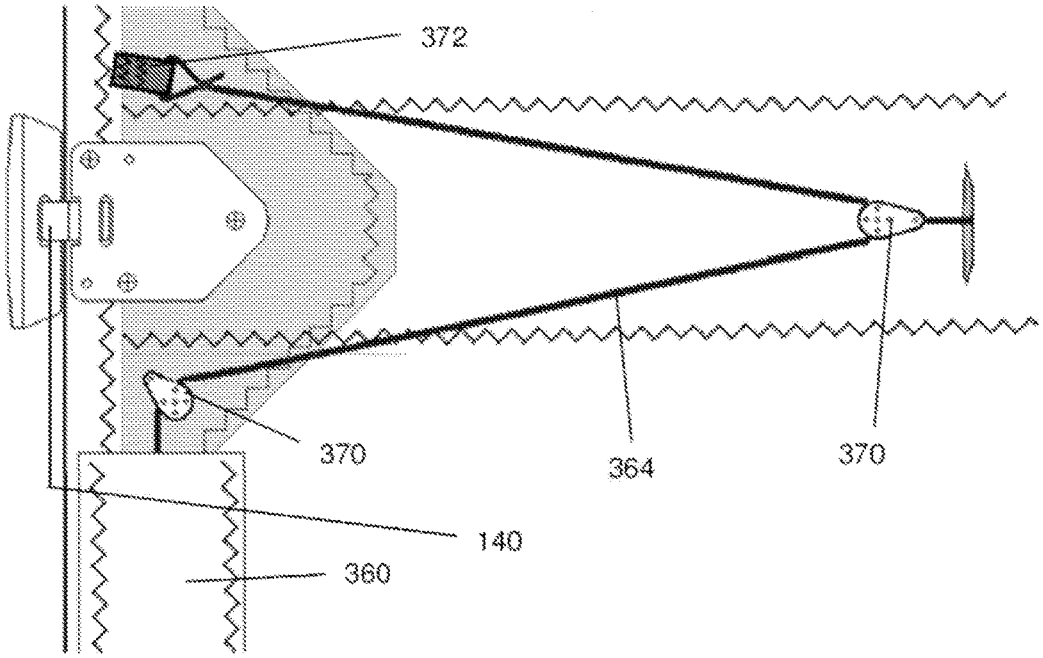
FIG. 23 is a schematic diagram showing the attachment of the leach control line to a luff control line on the uppermost controlled batten in the sail.

The batten control line 330 is connected to pulley 371 which is in turn connected to a luff control line 364. FIG. 23 shows the attachment of the batten control line 330 to a luff control line 364 on the uppermost controlled batten in the sail 14. Luff control line 364 terminates at the loop 372 fixed to the luff. When the luff control line 364 is drawn, it pulls on pulley 371 via pulley 370 so as to draw the batten control line 330.

When the batten control line 330 is eased the battens can then move relative to one another. The batten control line 330 is connected to the luff control line 364, such that the control line 364 can be adjusted from the bottom of the sail.

Thus in this embodiment there is an adjustable or flexible join between the leach ends of battens of the same height up the sail. The adjustable or flexible join may be controlled to allow a substantial amount of movement between the two adjacent leaches along the length of the elongated battens thus allowing the sail portions to rotate at the luff end a substantial angular amount before the compressive and tensile loads are induced in the elongated battens thus allowing the flexible sail portions to rotate, or twist, relative to the mast section without introducing thickness to the wing section. This is important because as the sail twists in the upper portions of the sail under wind load, effectively more mast rotation is induce relative to the sail portions. This subsequently causes more thickness to be induced into the wing section. This is undesirable as the section may become too thick and lead to stalling of the section, or it may also produce more lift (ahead of stall) and this may be undesirable.

In an embodiment the elongated battens on one sail portions are prevented from moving laterally apart at the leach from the corresponding batten on the other sail portion by a connecting ring or loop 344 which connects webbing straps/cords 289 which run longitudinally along the both batten pockets (and are typically also used to secure the batten into the pocket). The batten control line 330 can also pass through this loop or ring 344 so as to ensure that the loop or ring is pulled to the leach on each tack.

In an embodiment the amount of movement between the two adjacent leaches along the length of the elongated battens can be controlled to provide the appropriate amount of section thickness at the rotated or twisted displacement of the sail portions.

Figure 24:
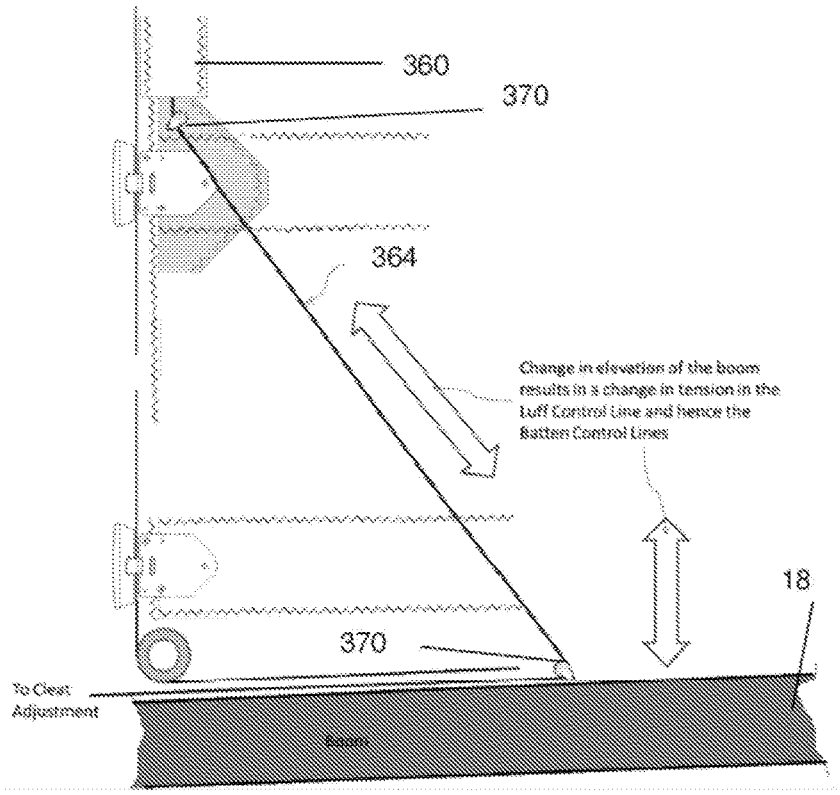
FIG. 24 is a schematic diagram showing attachment of the luff control line to the boom.
Figure 25:
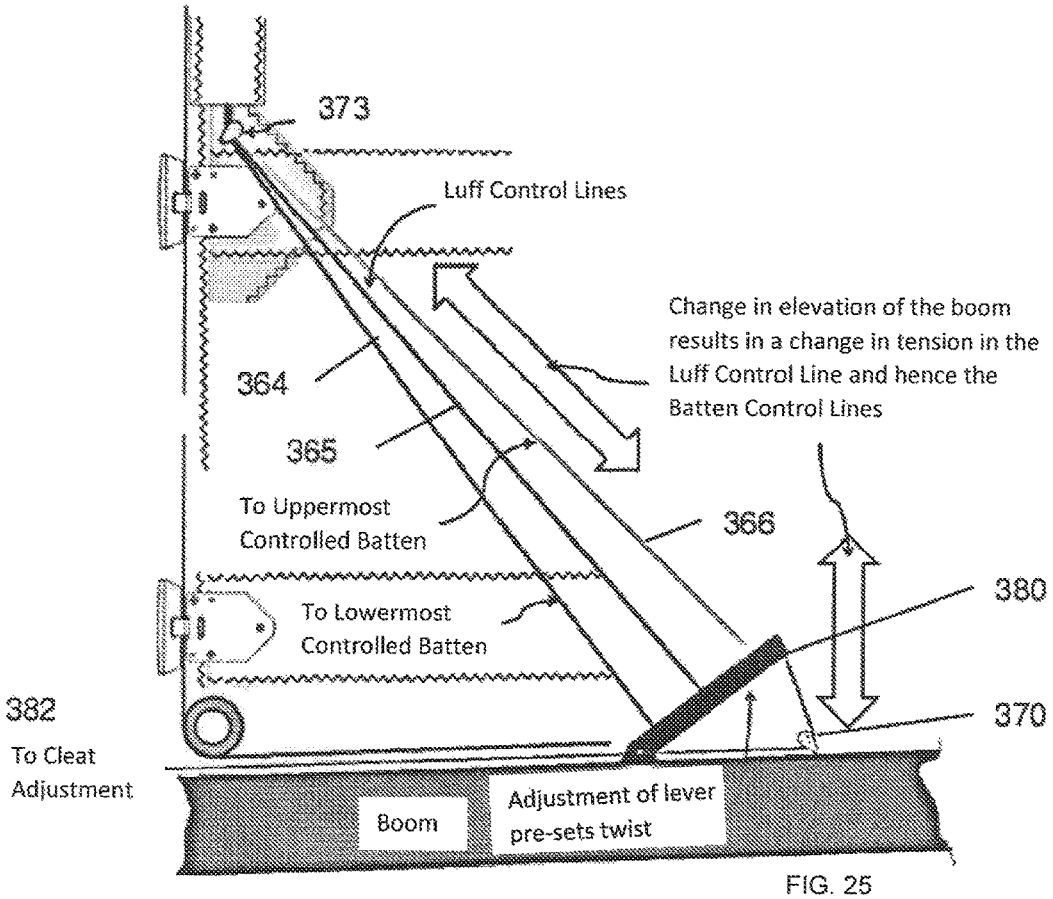
FIG. 25 is a schematic diagram showing attachment of multiple luff control lines to the boom.
Figure 26:
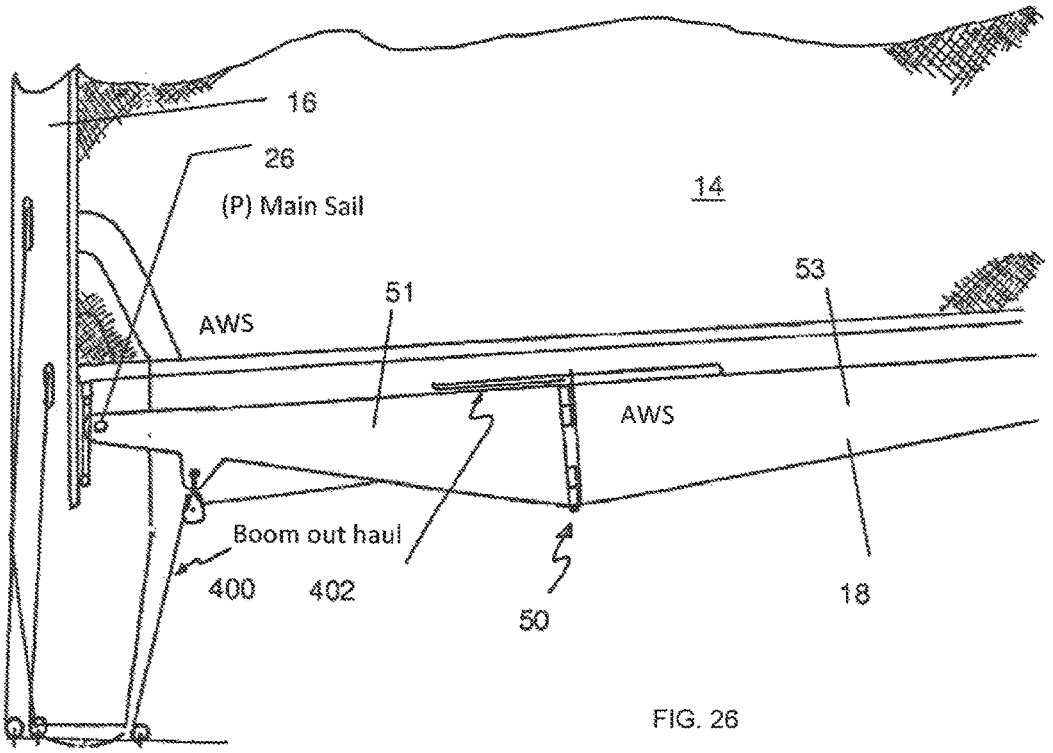
FIG. 26 is a schematic partial side elevation showing an articulated boom attached to the mast according to an embodiment of the present invention.

In an embodiment a means is provided the allow substantially more amount of movement between the two adjacent leaches along the length of the elongated battens at the top of the sail portions relative to the bottom of the sail portions to allow an increasing rotational displacement of the sail portions closer to the top of the sail. This is achieved by either a self-adjusting mechanism whereby the batten control lines 330 are fixed to a single luff control line 364 as shown in FIG. 24 and the upper battens are more prone to twist and hence will take up more of the luff control line 364. Alternatively, as shown in FIG. 25 each batten control line can have a luff control line 364, 365 and 366 and these can be affixed to a control lever 380 at the boom to allow adjustment and pre-setting of the twist.

In a still further aspect of the present invention controls of the amount of movement between the two adjacent leaches along the length of the elongated battens can be linked to the boom section of the sail in a manner which allows the rotational displacement at the top of the sail to increase as the downward force on the boom is decreased.

Figure 21:
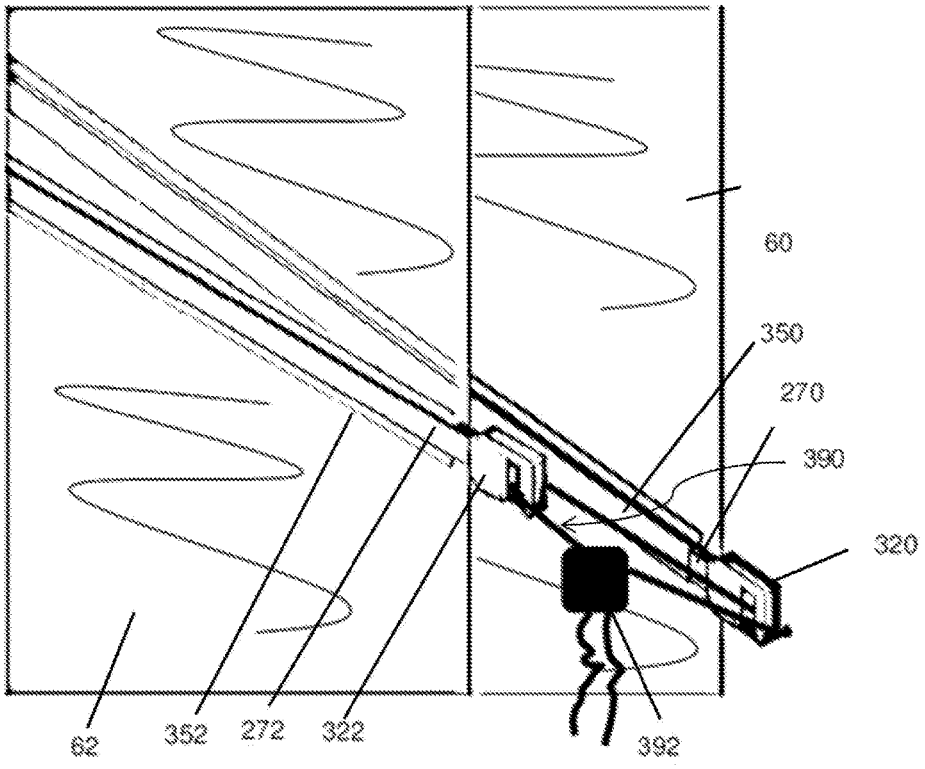
FIG. 21 is an oblique view of battens of the sail of FIG. 2, with an alternative leach control mechanism.

FIG. 21 shows an alternative for of leach control. Here the amount of movement between the two adjacent leaches along the length of the elongated battens can be controlled by the use of a flexible elastic joiner 390, for example elastic shock cord. The tension in the shock cord can be adjusted by the use of adjuster 392 to provide a varying amount of movement at each batten pair. Note that FIG. 21 shows one possible attachment of the shock cord whereas any attachment either of the battens or the leaches adjacent to the battens may be used to achieve the same result.

According to an aspect of the present invention the boom pivotally coupled to the mast at one end and which at another end the sail portions are coupled at a clew, wherein the boom is controllable articulated between its ends.

As shown in FIG. 26 to FIG. 29B, an articulated boom section is a means to rotate the mast 16 and induce the wing section asymmetry whereas the boom 18 which is articulated with a vertical hinge 50 which allows the boom 18 to displace in the mid-section to either port or starboard such that when the vessel is on a port heading the boom mid-section is displaced to port and when the vessel is on a starboard heading the boom mid-section is displaced to starboard and the boom is fixed to the mast in a manner that does not allow the lateral angle between the front section of the boom and the mast section to change. Thus when the boom mid-section is displaced to port the mast rotates in a clockwise direction as viewed from the top of the mast and when the boom mid section is displaced to starboard the mast rotates in an anti-clockwise direction as viewed from the top of the mast. The boom 18 has a first portion 51 extending form the mast 16 to the hinge 50, and a second portion extending form the hinge 50 to the end of the boom 18.

Figure 27:
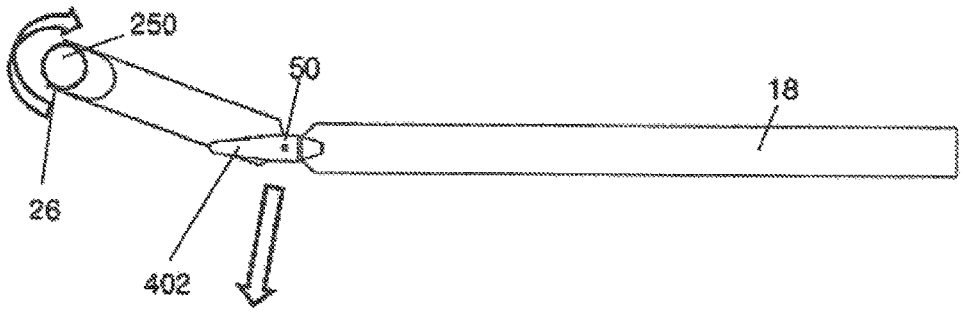
FIG. 27 is a top view of the articulated boom of FIG. 26 rotated to 15 degrees for a port tack setting.
Figure 28:
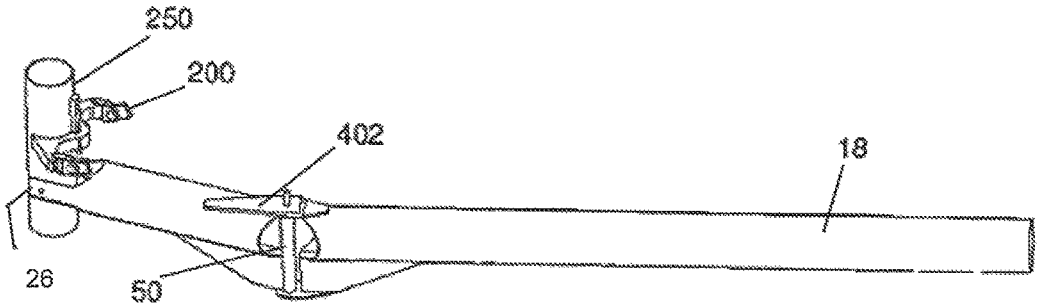
FIG. 28 is an oblique view of the articulated boom of FIG. 26 affixed to the mast.

In FIG. 27 the articulated boom is rotated to 15 degrees for a Port tack setting.

Figure 29A:
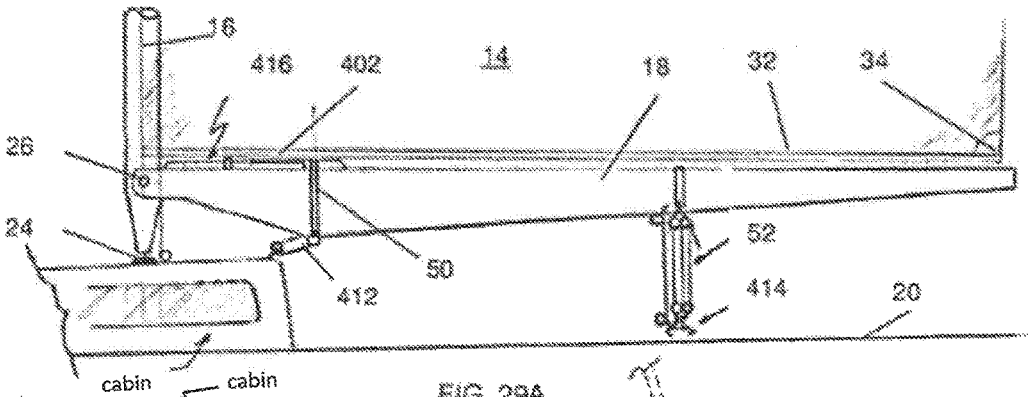
FIG. 29A is a schematic elevation of a mainsheet system used to articulate boom to required position when sail load is applied according to an embodiment of the present invention.
Figure 29B:
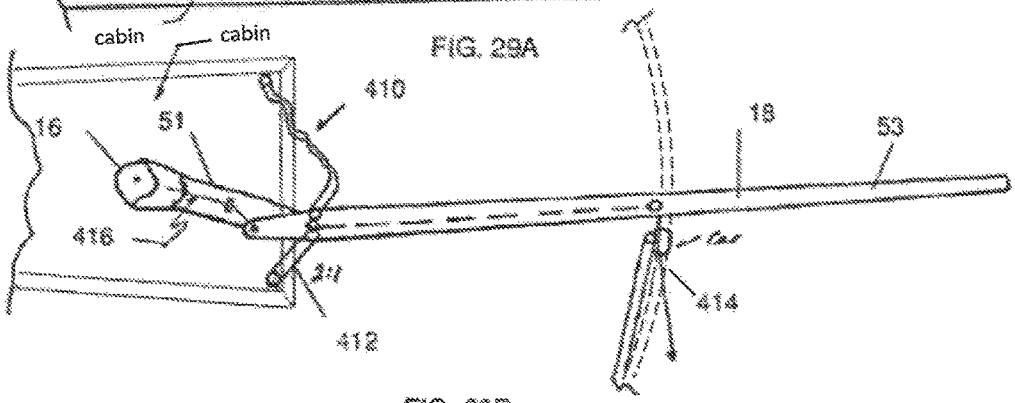
FIG. 29B is a schematic plan view of the system of FIG. 29A.
Figure 30C:
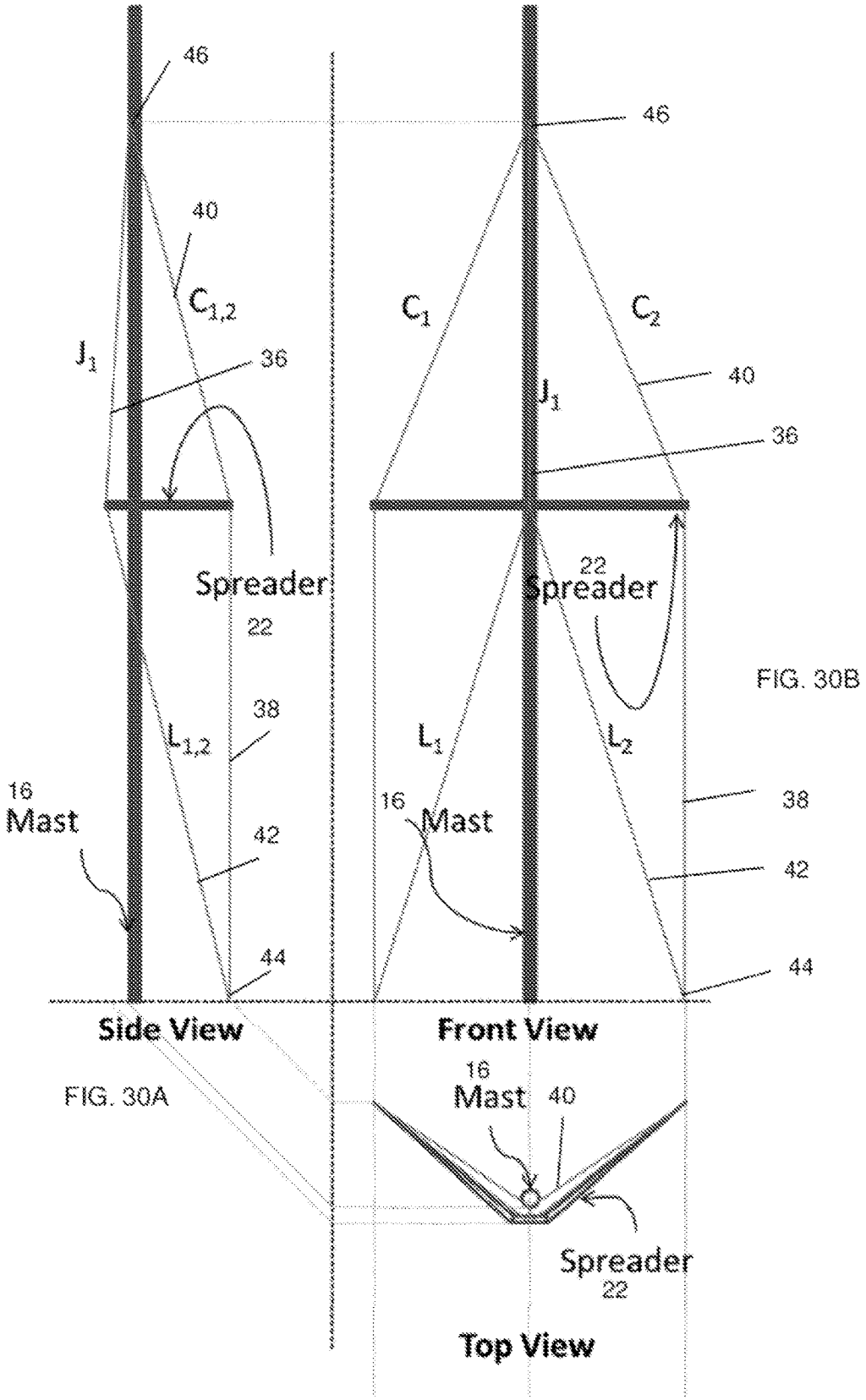
FIG. 30C is a top view of the configuration of FIG. 30A.
Figure 31:
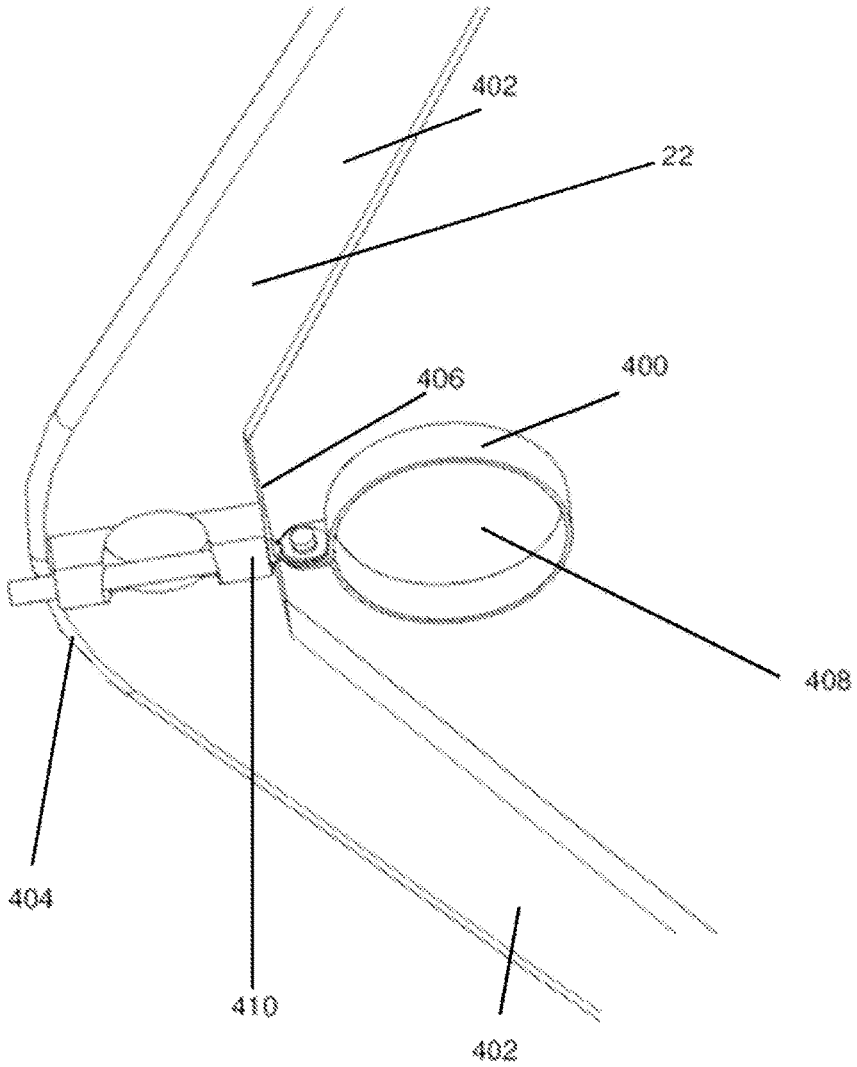
FIG. 31 is an oblique view of the spreader assembly of FIGS. 30A to 30C.
Figure 32:
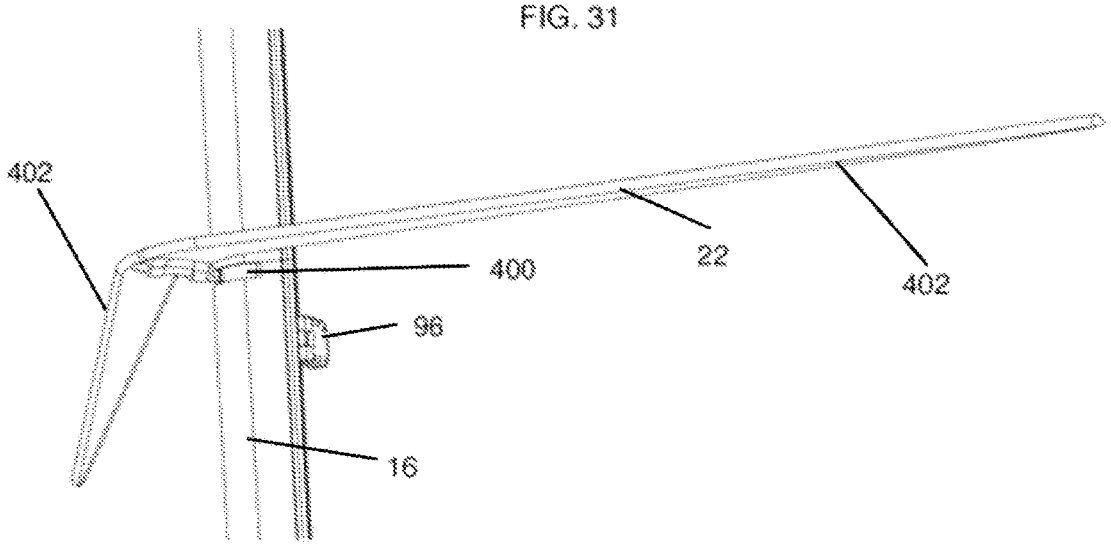
FIG. 32 is an oblique view showing the attachment of the spreader assembly of FIG. 30 to the mast.
Figure 33:
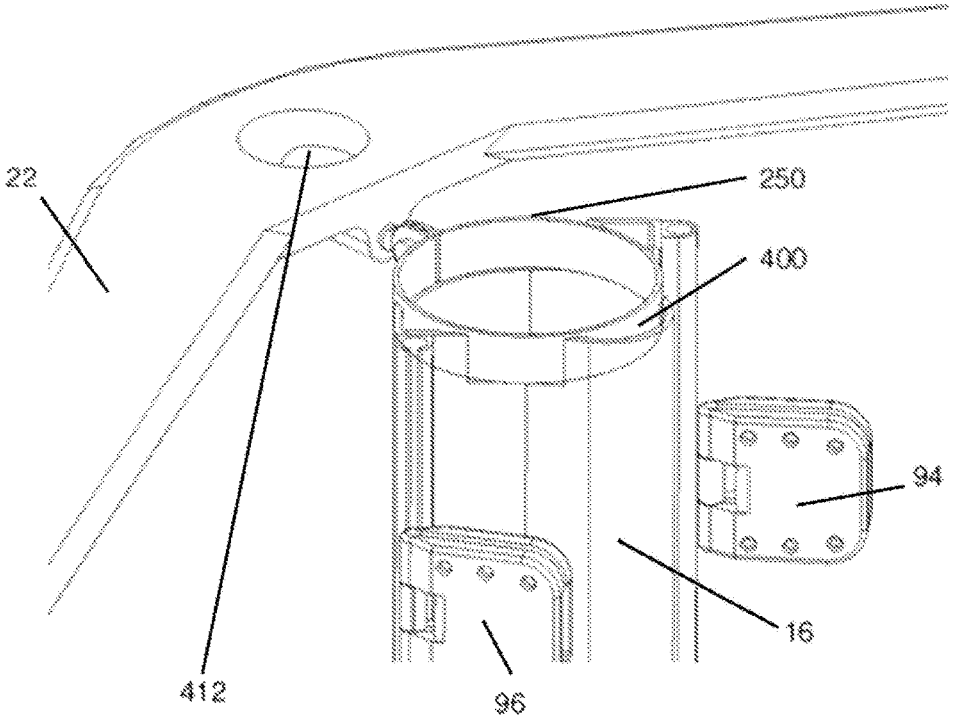
FIG. 33 is another oblique view of the showing the attachment of the spreader assembly of FIG. 30 to the mast.

FIG. 29B shows the articulated boom affixed to a mast and rotated into a port tack configuration.

In an embodiment a means is provided by which the load required to articulate the boom is applied by the main sheet system 414 whereby the wing section asymmetry is induced by the force of the wind and thus induces the asymmetry for a port heading when the wind is substantially from the port side of the vessel, and induces the asymmetry for a starboard heading when the wind is substantially from the starboard side of the vessel.

In an embodiment a means is provided to limit the amount of lateral displacement of the boom mid-section to either port or starboard thus limiting the amount of mast rotation and hence wing section thickness that is induced.

Cords 410 and 412 are connected to the second portion of the boom 53. In this setting cord 410 is slack and cord 412 is tight urging to the boom 18 to articulate in a particular direction. The amount of articulation may be controlled by a control arm 402 connected to the second portion 53, but extending past the hinge 50. The arm may be controlled by a cord 416.

Cord system 52 may extend between the boom 18 and the deck 20 and in some embodiments may operate as the mainsheet system or may operate to provide control over the horizontal angle of the boom 18 so as to operate as a boom yang.

In accordance with a still further aspect of the present invention the mast may be supported by stays or shrouds 36, 38, 40 and 42 and it may be an engineering requirement to have one or mare spreaders 22 or mid panel support for the mast 16. The spreader 22 is rotatable about an axis of rotation of the mast, such that the spreader 22 is substantially stationary relative to the deck 20 of the boat. In an embodiment the mast 16 can rotate through an operational range (say +/−55 degrees). The spreader 22 is attached to the mast via a ring or hoop 400 that is supported by the stays thus allowing the mast 16 to rotate about (or close to) its geometric centre and hence resulting in minimal deflection of the stays or shrouds when the mast is rotated.

Stays 38, 42 and Lower shrouds L1 and L2 attach to the deck at point 44 and stays 36. 40 and Jumper shroud 36 attach to the upper part of the mast at 46. The lower end of the Jumper shroud 36 and the upper ends of Lower shrouds L1 and L2 are coincidentally connected together (or in close proximity) to the Spreader 22. Where there are multiple spreaders used, the Jumper shroud is connected between the lower and upper spreaders (and then to the upper part of the mast) and the diagonal shrouds are connected for the upper spreaders are connected to the tips of the spreaders below. In this way multiple spreaders can be spaced along the length of the mast, The spreader 22 has elongate arms 402 that are typically swept aft. The stays 38 and 40 are attached to tips of the arms 402. Stays 42 and 36 are attached between the nose 404 and the aft face 406 of the spreader 22. An aft face 406 opposite the nose 404 has the ring 400 connected to it by connection 410. The mast 250 is able to be located in the inside 408 of the ring 400. The ring 400 is supported at the desired height on the mast 16. The spreader 22 is able to be both twisted and rotated downwards by connection 410 so as to provide two degrees of freedom of the spreader assembly. The spreader 22 may be provided with a hole 412 between the nose 404 and aft face 406 to allow the passage of cord from one side of the spreader 22 to the other. In this case a pin connecting the spreader 22 to the ring 400 passes through the hole 412 and the each of the Lowers shroud and the Jumper shroud are attached to this pin. The Lowers and the jumper shroud must be connected to the spreader assembly.

Figure 34:
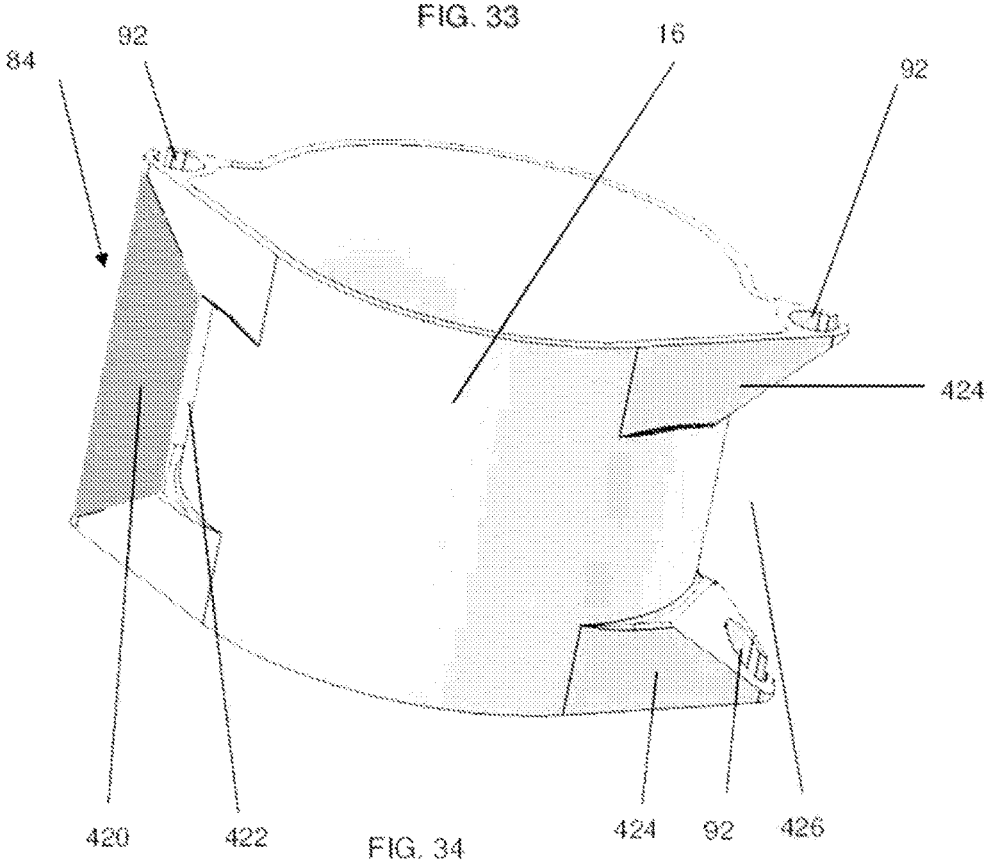
FIG. 34 is an oblique section of the mast of FIG. 4 adapted to fit a ring of the spreader.

The ring 400 passes between the sail tracks 92 and the mast 16 to allow hoisting of the sail portions 60 and 62. FIG. 34 shows an embodiment of a mast 16 that has lobes 424 separated by a gap 426. An insert 420 extends between the lobes 424 but also provides a space 422 in which the ring 400 is positioned. The lobes 424 and the insert 420 continue the flat portions (of which flat portion 84 is shown). The slider tracks 92 are formed in the lobes 424.

The present invention provides for a wing sail which can be hoisted, reefed and stowed much like a conventional sail and that can produce a semi rigid asymmetrical wing section aerofoil. The present invention provides for the ability to adjust the thickness and camber of the aerofoil wing section and to produce asymmetry on both port and starboard headings.

The present invention provides for substantial simplification over the prior wing sail, thus reducing weight and cost.

The present invention also provides a means of controlling span wise twist in the aerofoil section to further improve the aerodynamic performance of the wing sail. The present invention also provides means of attachment of the sail portions to the mast using sail slides which allow the sail to be stacked when not in use.

The present invention also provides for the use of a pocket luff sail where the leading edge shape is achieved by the use of mast collars which are substantially similar to the mast shape. The present invention also provides for leading edge tubercles being formed by the mast collars further enhancing the aerodynamic performance of the wing sail.

The present invention also provides a means far controlling twist in the sail. The present invention also provides a means of supporting the wing sail rigging using rotating spreaders.

As with the original invention, the wing sail being controlled in the present invention is characterised in that comprises a flexible sail comprising two substantially identical flexible sail portions, each having a leach and a luff, the flexible sail portions being arranged to give the sail an effective thickness which is substantially greater than either of the flexible sail portions individually and a pocket means arranged to receive an elongated batten having flexure in at least two dimensions which stiffen the sail portions from luff to leach.

Modifications may be made to the present invention within the context of that described and shown in the drawings. Such modifications are intended to form part of the invention described in this specification.

The invention claimed is:

1. A rigging comprising:

a mast having a starboard side and a port side, wherein the mast is controllably rotatable in either direction about a longitudinal axis;

a flexible sail comprising a starboard flexible sail portion and a substantially identical port flexible sail portion, each flexible sail portion having a luff and a leach, wherein the luff of each sail portion is connected to a respective side of the mast;

a plurality of elongated battens, each of which extends substantially between the luff and the leach of one of the respective sail portions, each of which is in contact with the respective flexible sail portion, and each of which is pivotally connected to a respective outermost part of the starboard or port side of the mast;

wherein rotation of the mast causes the battens connected to one of the sail portions to be compressed along their length so as to bend one of the sail portions to increase the camber thereof and causes the battens connected to the other sail portions to be tensioned along their length so as to partly straighten the other sail portion which changes the shape of an aerofoil formed by the sail.

2. A rigging according to claim 1, wherein the mast comprises substantially flat portions at an angle to each other, each flat portion ending in a corner on one side of the mast at which the respective flexible sail portions are connected, wherein when the mast is rotated in one direction a surface of the flat portion on a side with the sail portion having the resulting increased camber and the surface of the sail portion have an air flow there-over that is relatively flat or undergoes a relatively small change in direction.

3. A rigging according to claim 2, wherein the surface of the flat portion on the side with the sail portion having the resulting increased camber and the surface of the sail portion have the air flow there-over that is most flat substantially before a maximum rotation of the mast in that direction.

4. A rigging according to claim 1, wherein the mast to sail portion is a partly straightened interface having a rounded or non-sharp corner.

5. A rigging according to claim 1, wherein the mast to sail portion is a partly straightened interface comprising an acute angle, wherein an airflow past the interface reattaches to the sail portion relatively close to the mast.

6. A rigging according to claim 1, wherein the mast is profiled so that when the mast is rotated in one direction airflow passing from the mast to sail portion with the increased camber remains relatively attached to the sail portion.

7. A rigging according to claim 1, wherein the mast is profiled so that when the mast is rotated in one direction airflow passing from the mast to sail portion that is partly straightened reattaches to the sail portion relatively close to the mast.

8. A rigging according to claim 1, wherein attachment of the luff of at least one of the sail portions is such that there is no gap or only a small gap between the luff and the mast.

9. A rigging according to claim 8, wherein the small gap is such that it discourages airflow on a windward side through the gap.

10. A rigging according to claim 8, wherein the small gap is positioned where it is most likely for there to be an airflow separation bubble on a windward side.

11. A rigging according to claim 2, wherein the angle between the flat portions is between 60 and 100 degrees.

12. A rigging according to claim 1, wherein a degree of rotation of the mast controls compression and tension in the battens.

13. A rigging according to claim 1, wherein the leaches are controllably moveable relative to each other such that one of the leaches is closer to the mast than the other according to a tack of the sail.

14. A rigging according to claim 13, wherein the movement of the leaches is controlled by controlling a separation allowed between leach ends of the battens.

15. A rigging according to claim 13, wherein movement of the leaches controls a mean camber of the aerofoil.

16. A rigging according to claim 1, wherein the rigging further comprises a boom pivotally coupled to the mast at one end and which at another end the sail portions are coupled at a clew.

17. A rigging according to claim 16, wherein an amount of separation between the leaches is varied according to a length along the leach from the clew.

18. A rigging according to claim 14, further comprising a boom that is pivotal in a horizontal plane, wherein an angle of the boom in the horizontal plane is controllable and the angle of the boom in the horizontal plane is configured to control the separation allowed between leach ends of the battens.

19. A rigging according to claim 1, further comprising a boom that is pivotal in a horizontal axis between its ends and rotation of the mast is adjusted relative to a longitudinal axis of the boom.

20. A rigging according to claim 19, wherein the boom is controllably articulated between its ends.

21. A rigging according to claim 1, wherein the flat portion of the mast is formed by a mast pocket stretched between mast collars.

22. A rigging comprising:

a mast having a starboard side and a port side, wherein the mast is controllably rotatable in either direction about a longitudinal axis;

a flexible sail comprising a starboard flexible sail portion and a substantially identical port flexible sail portion, each flexible sail portion having a luff and a leach, wherein the luff of each sail portion is connected to a respective side of the mast;

a plurality of elongated battens, each of which extends substantially between the luff and the leach of one of the respective sail portions, each of which is in contact with the respective flexible sail portion;

wherein the battens connected to one of the sail portions may be compressed along their length so as to bend one of the sail portions to increase the camber thereof and causes the battens connected to the other sail portions to be tensioned along their length so as to partly straighten the other sail portion which changes the shape of an aerofoil formed by the sail;

wherein the leaches are controllably moveable relative to each other such that compression is applied to the one or more of the battens on a leeward side of the sail by tension in a corresponding one or more of the battens on a windward side of the sail.

23. A rigging according to claim 22, wherein the leaches are controllably moveable relative to each other so as to determine spacing between the leaches.

24. A rigging comprising:

a mast having a starboard side and a port side, wherein the mast is controllably rotatable in either direction about a longitudinal axis;

a flexible sail comprising a starboard flexible sail portion and a substantially identical port flexible sail portion, each flexible sail portion having a luff and a leach, wherein the luff of each sail portion is connected to a respective outermost side of the mast;

a plurality of elongated battens, each of which extends substantially between the luff and the leach of one of the respective sail portions, each of which is in contact with the respective flexible sail portion;

wherein the battens connected to one of the sail portions may be compressed along their length so as to bend one of the sail portions to increase the camber thereof and causes the battens connected to the other sail portions to be tensioned along their length so as to partly straighten the other sail portion which changes the shape of an aerofoil formed by the sail;

wherein leach end of battens are moveable relative to each other.

25. A rigging according to claim 24, wherein relative displacement of each of the leach ends of the battens is controllable.

26. A rigging according to claim 24, wherein relative displacement of the leach ends of the battens is automatically controlled by an angle of the boom to which the sail portions are attached.

27. A rigging according to claim 24, wherein the sail portions provide differing relative movement of corresponding portions of the leaches to each other, wherein an amount of relative movement is controlled according to a height of the leach portions from a deck.

28. A rigging comprising:

a mast having a starboard side and a port side, wherein the mast is controllably rotatable in either direction about a longitudinal axis;

a flexible sail comprising a starboard flexible sail portion and a substantially identical port flexible sail portion, each flexible sail portion having a luff and a leach, wherein the luff of each sail portion is connected to a respective outermost side of the mast;

a plurality of elongated battens, each of which extends substantially between the luff and the leach of one of the respective sail portions, each of which is in contact with the respective flexible sail portion;

a boom pivotally coupled to the mast at one end and which at another end the sail portions are coupled at a clew, wherein the boom is controllably articulated between its ends;

wherein articulation of the boom causes the mast to rotate and then causes the battens connected to one of the sail portions to be compressed along their length so as to bend one of the sail portions to increase the camber thereof and causes the battens connected to the other sail portions to be tensioned along their length so as to partly straighten the other sail portion which changes the shape of an aerofoil formed by the sail.

29. A wind propelled craft comprising the rigging as claimed in claim 1.

30. A rigging according to claim 22, wherein control of the movement of the leaches is according to a height of the respective battens in contact with the flexible sail.

* * * * *